US011193681B2

(12) United States Patent
Addison, II et al.

(10) Patent No.: US 11,193,681 B2
(45) Date of Patent: Dec. 7, 2021

(54) BIMODAL EQUALIZATION PRESSURE VENT

(71) Applicant: Qorbo IP, LLC, Atlanta, GA (US)

(72) Inventors: Walter D. Addison, II, Atlanta, GA (US); James H. Holland, Jr., Florence, SC (US)

(73) Assignee: QORBO IP, LLC, Atlanta, GA (US)

( * ) Notice: Subject to any disclaimer, the term of this patent is extended or adjusted under 35 U.S.C. 154(b) by 255 days.

(21) Appl. No.: 15/975,963

(22) Filed: May 10, 2018

(65) Prior Publication Data

US 2018/0328608 A1 Nov. 15, 2018

Related U.S. Application Data

(60) Provisional application No. 62/504,376, filed on May 10, 2017, provisional application No. 62/597,799, filed on Dec. 12, 2017.

(51) Int. Cl.
*F24F 7/02* (2006.01)

(52) U.S. Cl.
CPC ..... *F24F 7/02* (2013.01)

(58) Field of Classification Search
CPC ..... F24F 7/02
USPC ..... 454/359
See application file for complete search history.

(56) References Cited

U.S. PATENT DOCUMENTS 1,897,440 A * 2/1933 Richardson ..... F23L 17/10 454/31
1,931,066 A 10/1933 Eckert
2,188,699 A * 1/1940 Barron ..... F24F 7/02 454/20
2,878,743 A * 3/1959 Trunnell ..... F24F 7/02 454/366
3,347,147 A * 10/1967 Howard ..... F24F 7/02 454/38
3,984,947 A 10/1976 Patry
4,484,424 A 11/1984 Logsdon
4,530,273 A * 7/1985 Smith ..... F24F 7/02 454/339
4,538,508 A * 9/1985 Ballard ..... B21D 53/00 137/852
5,005,328 A * 4/1991 Holtgreve ..... E04D 1/30 454/368
5,551,916 A * 9/1996 Morse, Jr. ..... E04H 9/14 454/340
7,001,266 B2 2/2006 Jones et al.
(Continued)

*Primary Examiner* — Allen R. B. Schult
(74) *Attorney, Agent, or Firm* — Smith, Gambrell & Russell LLP

(57) ABSTRACT

This invention is an improved vent for a roofing system comprising: a flange having spacers defining an air channel between the roof system and the flange; a flange opening in fluid communication with the roofing system; a tube carried by the flange; a lower valve disposed in a fluid flow path between the roof system and the tube; an external extension assembly extending outward from the tube; a distal opening included in the external extension assembly configured to draw fluid from the roof system through the tube out the distal opening due to an efflux of external fluid across the distal opening; and, a check valve in fluid communications with the external extension assembly, wherein the check valve and the lower valve open when fluid is drawn from the roof system through the tube and out the distal opening.

17 Claims, 24 Drawing Sheets

(56) References Cited

U.S. PATENT DOCUMENTS

| | | | |
|---|---|---|---|
| 7,025,671 | B2 | 4/2006 | Lin |
| 7,607,974 | B2 | 10/2009 | Jones et al. |

* cited by examiner

BIMODAL EQUALIZATION PRESSURE VENT

BACKGROUND OF THE INVENTION

1) Field of the Invention

The present invention relates to a vent allowing for pressure equalization or the creation of negative pressure associated with a membrane roof.

2) Description of Related Art

In the building industry, both commercial and residential, some roof designs are flat. Generally, flat roofs are those roofs that have a slope or pitch of 4/12 or less. Some roofs have little or no slope, but most building codes require a minimum of ¼" in 12 slope. For example, commercial and industrial roof applications in the US prior to World War II were either cold tar pitch or asphalt built up roofs. Hence the acronym "BUR". Both roof systems were installed by mopping layers of felt in place and covering with a flood coat of asphalt or cold tar depending on the roof. Gravel for ballast and protection from the sun was added. However, by its nature, cold tar pitch can only be installed when the slope is ⅛" inch or less. It has a lower melting point than hot asphalt and will become liquid at low temperatures. Flat roof systems can be broken into three separate elements of construction: waterproofing material; insulating material; method of attachment to the underlying deck of the building structure. The deck of a building structure can be a major determining factor in the selection of waterproofing material or insulating material used in roof assembly as well as the method of attachment.

When EPDM rubber was introduced as a roofing membrane that could be installed from rolled sheets of rubber and then glued together to form a waterproofing material, a radical change took place in the roofing industry. A whole new selection of waterproofing membranes and chemical formulations evolved. Single ply roofing had arrived along with a range of membrane types to take the place of "BUR" systems. Acronyms for single ply membranes became an alphabet soup of selections. PVC, CPE, CSPE, PIB, NTB, and TPO were just some of the acronyms to arrive for waterproofing materials along with EPDM. For the asphalt arena, technologies evolved for producing prefabricated rolls of modified asphalt in the form of SBS and APP materials. SBS was a rubberized asphalt and APP was an asphalt modified with a plastic material. They were referred to as modified bitumen. These new single ply materials comprise the vast majority of the roofing industry applications today. Along with the selection of single ply membranes came new methods of securement. Early EPDM roofs were ballasted with smooth river rock as were other single ply membranes. However, ballast became hard to find and was eliminated from use in high wind areas and high rise construction. Mechanically attached roofs evolved along with fully adhered roofs. Mechanical attachment was impacted by deck type. Fully adhered roofs evolved, but the material and labor cost for installation was significantly higher than ballasted or mechanically attached roofs. The first practical use of a pressure equalization vent in commercial roofing was done in the 80's when asbestos was a major issue in commercial roof tear offs. The use of a Single Ply membrane loose laid over an insulation board without disturbing or penetrating the asbestos laden material became a solution to an otherwise expensive and time consuming project.

There are several common problems with roofs in general and specific problems with membrane roofs. Because the purpose of the roof is to keep moisture and other materials out of the underlying structure, it also has the effect of trapping moisture, gas, and other materials under one of more with the layers of the roof. It is desirable to have a method to allow such moisture and gas to escape without compromising the integrity of the roof. As for membrane roofs, these are particularly sensitive to changing wind speeds and wind direction. These forces can cause membranes to flutter and pull away from their decking. When wind strikes a building, it generates a positive pressure on the windward face. As it accelerates around the side of the building and over the roof, it creates reduced or negative pressure over the roof. The greatest pressures are experienced at the windward corners and edges of the roof, where the negative pressure exerted on the roof can be several times that experienced in the central areas. Without wind, the membrane's upper surface is under the same pressure as its lower surface. When wind is present, this equilibrium is changed and the atmospheric pressure on the upper surface of the roof system can be lowered creating a lifting effect that can be damaging to the membrane and roof system.

Several attempts have been made to address these problems both with vents for allowing the escape of moisture and gas and with counteracting the effects of wind. For example, U.S. Pat. No. 1,931,066 discloses a built-up roof system with vents and particularly roof systems with a layer of insulating material that is interposed between an impervious foundation such as a roof deck and an outer layer of waterproof material. U.S. Pat. No. 3,984,947 discloses a roof structure comprised of a roof deck, roof insulation disposed over the deck, and a built-up roof disposed over the insulation. A one-way vent is included through which moisture within the roof structure and subsequently converted to vapor passes to the ambient surroundings. U.S. Pat. No. 4,484,424 discloses a roof vent that includes a plate and a housing integrally formed together. An opening in the plate extends upwardly into the hollow interior of the housing. The partition includes a hole allowing for fluid flow between the upper and lower sections. A diaphragm lays on the upper surface of the partition over the hole in the partition. The diaphragm prevents fluid movement from the upper section of the interior into the lower section of the interior but allows for reverse flow of fluid. U.S. Pat. Nos. 7,001,266 and 7,607,974 disclose a rooftop vent with two opposed convex domes separated by a gap. Wind blowing across the roof flows between the domes where it accelerates and creates a region of low-pressure that assists in securing the membrane to the roof preventing liftoff. U.S. Pat. No. 7,025,671 is directed to aerodynamic suction ventilator.

However, none of the attempts result in making use of multiple low-pressures that exist around a properly designed vent in windy conditions to assist in airflow under the roof membrane, which keeps moisture out, and to actually achieve lower air pressures under the membrane than on top of the membrane, keeping the membrane firmly in place, especially in windy conditions.

Accordingly, it is an object of the present invention to provide a roof vent that can allow moisture and gas to escape from under the membrane.

It is another object of the present invention to provide a roof vent that does not powered means of evaluating fluid from under the roof system.

It is another object of the present invention to provide a roof vent that does not compromising the integrity of the roof membrane. It is another object of the present invention to provide a roof vent that reduces or eliminates the liftoff effect of wind across a membrane roof.

SUMMARY OF THE INVENTION

The above objectives are accomplished according to the present invention by providing an improved vent for a roofing system comprising: a flange having spacers attached to a bottom surface of the flange defining an air channel between the roof system and the flange; a flange opening in the flange in fluid communication with the roofing system; a tube carried by the flange in fluid communications with the flange opening defined in the flange allowing fluid communications between the roof system and the tube; a lower valve disposed in a fluid flow path between the roof system and the tube; an external extension assembly extending outward from the tube; a distal opening included in the external extension assembly configured to draw fluid from the roof system through the tube out the distal opening due to an efflux of external fluid across the distal opening; and, a check valve in fluid communications with the external extension assembly, wherein the check valve and the lower valve open when fluid is drawn from the roof system through the tube and out the distal opening.

The improved vent can include a major spacer and a minor spacer carried by the flange. An elbow can be included in the external extension assembly redirected fluid from the roof system toward the flange. A lower extension portion can be included in the external extension assembly. A screen can be attached to the lower extension portion. A set of external extension assemblies can be circumferentially disposed around the tube. An output area defined by the openings in the external extensions assemblies can be about equal to a flange area defined by the areas of the flange less the area of the spacers. The output area can be in the range of 5 inches$^2$ to 10 inches$^2$.

The improved vent can include a tube in fluid communications with the roof system; an external extension assembly extending outward from the tube configured to draw fluid from the roof system through the tube out the external extension assembly due to an efflux of external fluid across the external extension assembly; and, a check valve in fluid communications with the external extension assembly whereas the check valve opens when fluid moves across the external extension assembly providing for fluid flow from the roof system through the tube to move fluid from the roof system through the tube and out the external extension assembly. A flange can be attached to the tube having a flange opening allowing fluid communications between the roof system and the tube. A flange opening can be carrying a lower valve. A cap can be disposed at a top portion of the tube.

The improved vent can include a tube in fluid communications with the roof system allowing fluid communications between the roof system and the tube; a distal opening in fluid communications with the tube configured to draw fluid from the roof system through the tube out the distal opening due to an efflux of external fluid across the distal opening; and, a check valve in fluid communications with the distal opening whereas the check valve opens when fluid moves across the distal opening. The improved vent can include a flange, and, a spacer carried by the flange defining an airway between the flange and the roof system. A lower valve can be carried by the flange. A cap disposed on a top portion of the tube wherein a perimeter of the cap is larger than an area occupied by one or more distal openings. The tube can be defined by an upper tube and a lower tube.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figure 1:
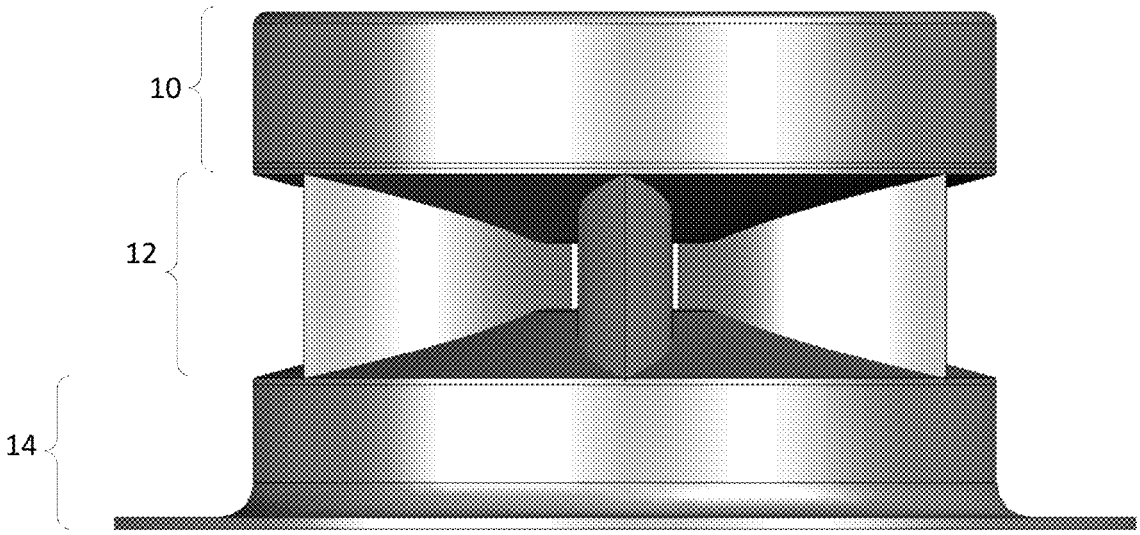
FIG. 1 is an elevated side view of aspects of the invention.

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

This invention can be used on residential or commercial roofs that have been overlaid with any one of a number of roofing membranes. The membrane can be originally installed or used over an existing roof system. The invention herein can provide for air pressure below the membrane to be near or below the air pressure above the membrane, thereby reducing the tendency of the membrane from lifting away from the underlying roof during winds and/or low-pressure scenarios. In one embodiment, multiple vents can be included in an interconnected system to provide for adequate protection from wind damage for a given sized roof.

The invention operates in two primary modes, equalization pressure vent (EPV) mode and negative pressure vent (NPV) mode. One mode, called equalization pressure vent (EPV) mode, is when there may be little or no wind and there is air pressure that is present between the roof and the membrane that is greater than the air pressure above the roof or building. Therefore, there would be a pressure gradient inside the vent of the present invention. When the pressure inside the vent reaches a sufficient level, any one of several one-way check valves inside the vent can open and allow air to flow from under the membrane to the outside. Therefore, the pressure inside the membrane can be made to be equal to the outside air pressure. Since the vent is designed to be airtight-sealed to the roofing membrane, any air that is flowing from inside the vent to the outside is actually flowing from under the membrane to the outside. No external wind is necessary to cause the vent to automatically equalize the pressure under the membrane to the outside air pressure.

Another mode, called Negative Pressure Vent (NPV) mode, is where there is sufficient wind present that is blowing from any direction and engages the vent. Because of the design of the vent, when the wind engages the vent, there will be low-pressure zones created at some of the downward facing ports around the center tube. These low-pressure zones will be lower than the pressure of the ambient wind. The check valves associated with these ports will open to allow any air to flow out of the port. It is also expected that there will be higher pressure zones at some of the other ports, but the check valves connected to those ports will restrict airflow at those ports, resulting in the lower pressure from the low-pressure zones to be presented to underneath of the roof membrane and causing air to flow from under the membrane until a point where the pressure under the membrane is equal to the low-pressure zones at some of the ports.

Referring to FIG. 1, in one embodiment, the vent can consist of three main sections, the lower chamber/flange section 14, the vent/channel section 12, and the upper chamber/cap section 10. Each section of the vent can be constructed of any plastic or metal type material that is suitable for the conditions of the application. Each section can be interconnected to the others by any airtight means that does not allow air to escape at the connection points between the sections. In one embodiment, the three sections are removably attached to each other in order to assist in maintenance of the vent as well as to allow for the vent to be usable with different types of roof membranes. In one embodiment, the vent/channel section can be connected to each other using threads and gaskets. In one embodiment, the sections can be connected to each other by screws and/or glues or welds.

Figure 2A:
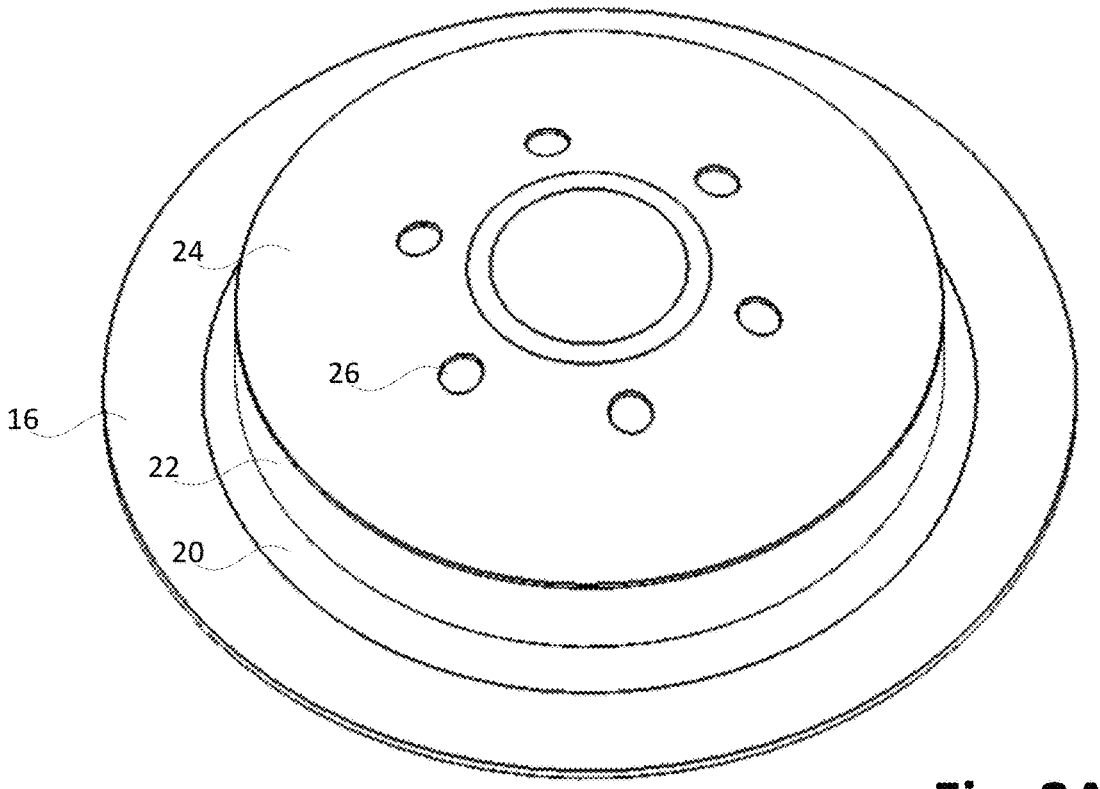
FIGS. 2A and 2B are top and bottom perspective view of aspects of the invention.
Figure 2B:
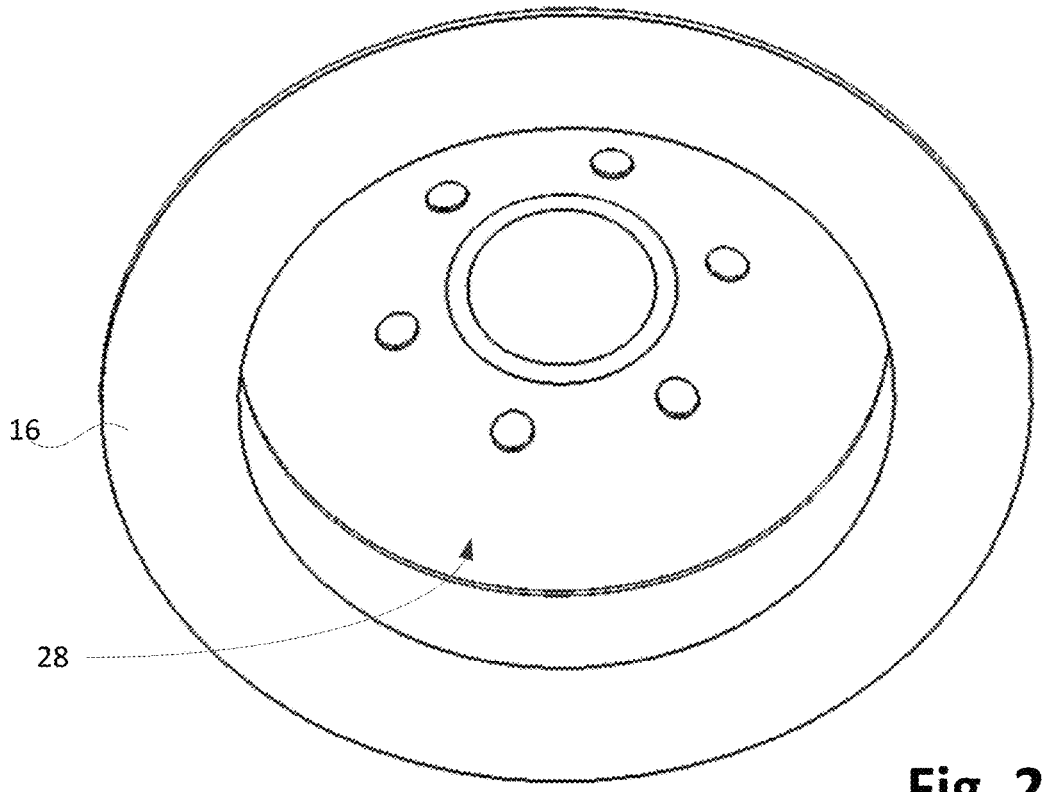

Referring to FIGS. 2A and 2B, the lower chamber/flange section or lower section 14 is shown in more detail. A flange 16 can be included in the lower section. An opening in the membrane can be created for receiving the vent while the flange is designed to be attached to a skirt or boot of similar membrane material which is placed over the flange and properly airtight sealed to the underlying membrane above the opening. The lower section can include a curved area 20 to assist with forming a water resistant seal between the vent lower section and the membrane. A lower section support wall 22 can be included to support a lower plate 24. In one embodiment, the lower plate 28 in FIG. 2B can include an upward slant toward a central point. The lower plate can include one or more lower plate openings 26, inside the dividers.

Figure 3A:
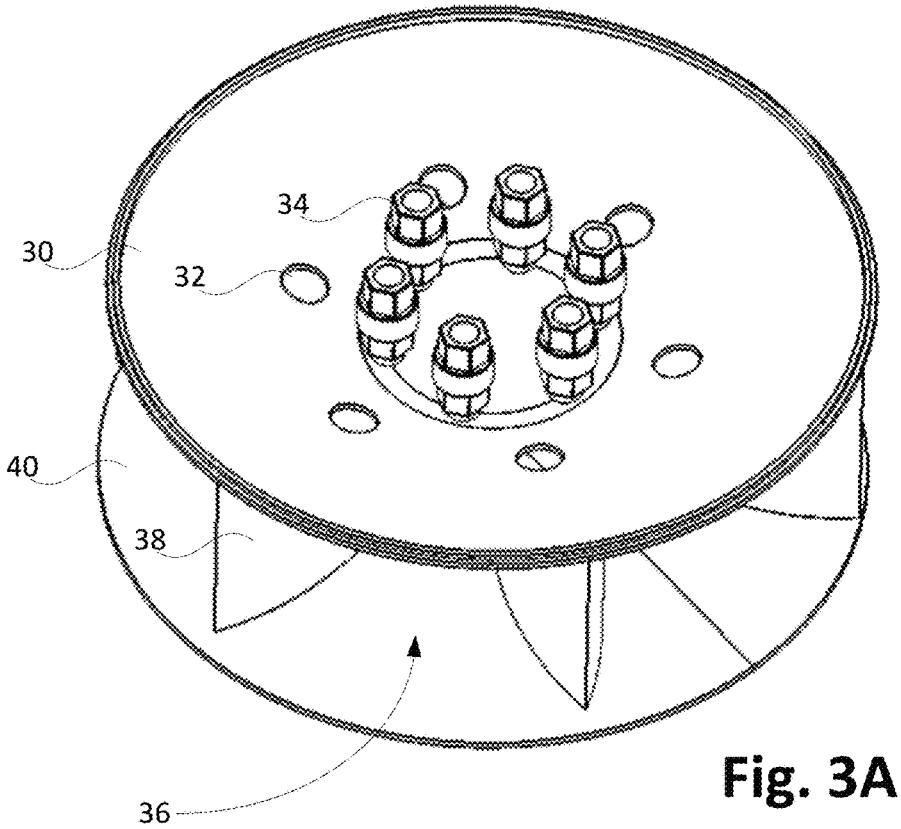
FIG. 3A is a perspective view of aspects of the invention.
Figure 3B:
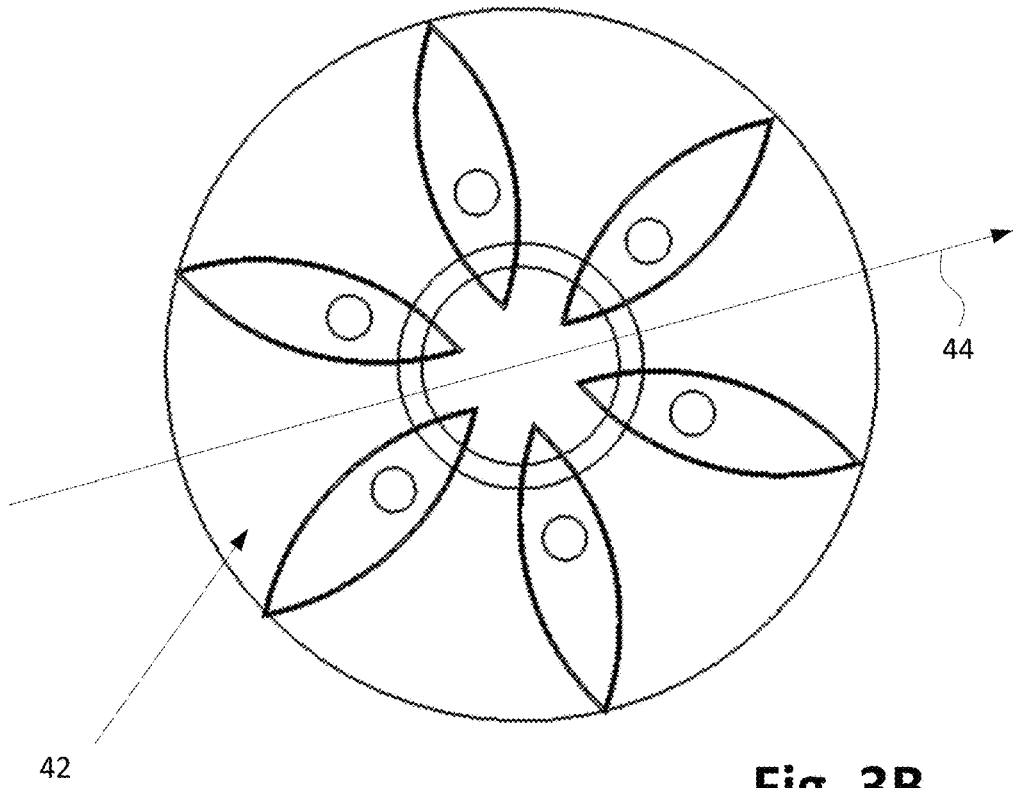
FIG. 3B is a top down view of aspects of the invention.

In one embodiment, the air inside the lower chamber is in fluid contact with the air inside the upper chamber through lower plate openings 26 in FIG. 2A and upper plate openings 32 in FIG. 3A both of which reside inside the hollow dividers of the vent/channel section.

In one embodiment, the lower air chamber itself can be open to air gap spaces under the roof membrane when the flange of the lower chamber/flange is airtight sealed under the roofing membrane. Air gap spaces are naturally forming pathways for air to move in the space between the roof membrane and the roof deck. The size and number of lower plate openings, inside the dividers, between the upper and lower chambers should allow for sufficient air volume to handle pressure equalization in a timely manner. In one embodiment, the total area of the lower plate openings equals or exceeds the sum of the areas of all of the check valves described herein. The upper chamber is open to the lower chamber and the lower chamber is open to the air spaces between the existing roof and the roof membrane. The vent, having an airtight seal to the roof membrane and the roof membrane having an airtight seal to the roof deck, results in air that exits the vent upper chamber originating from between the roof deck and the roof membrane.

For one embodiment and referring to FIGS. 3A through 3D, the vent/channel section is shown. The vent/channel section can include an upper plate 30 that can include openings 32, which are located above the interior of the dividers. In order to provide a structure that allows air from the lower chamber to exit to the outside through the lower and upper plate openings inside the dividers a number of one-way check valves 34 can be placed in the upper chamber directly over top of the channel openings, called ports, that are located over top of low-pressure points of each channel. These valves only open to allow air to pass from the upper chamber to the outside, i.e. the channel, and prevent air from traveling in the other direction. Since the upper chamber is connected to the lower chamber, in a fluid sense, any air that passes out of the upper chamber to the outside would have originated from under the membrane.

The vent/channel section can include subassemblies, namely, the upper plate 30, the one-way check valves 34, dividers 38, and a lower plate 40. The dividers can be placed in an airtight manner, between the upper and lower plates, circularly and equidistantly around the center of the vent to provide a number of equal sized air channels, between the dividers, around the 360 degrees of the vent in one embodiment. The dividers can be shaped such that they constrict air traveling toward the center of the vent in such a way as to create a low-pressure area just outside the center of the vent. In one embodiment, six dividers are used, but this number can be more or less. In one embodiment, the number of dividers is an even number to allow for air to enter any of the channel openings and to exit the opposite channel opening at about 180 degrees. This can result in less resistance and turbulence to provide for a more efficient operation.

In one embodiment with six dividers, there are six channel openings 42. Each channel opening can function as an inlet as well as an outlet. An inlet refers to a channel opening that is facing the direction that the wind is blowing from. The corresponding outlet, where most of the air exits the vent would be the channel opening that is directly opposite (180 degrees) of an inlet that is receiving the wind. The path 44 which airflow (wind) will follow between any inlet and the opposite outlet is called a channel. For a 6-divider vent, there are 3 bidirectional channels for airflow (wind) to travel that can be 120 degrees apart in one embodiment. Since channel openings are the channel openings at any given time, so if there is wind, at least one of the channel openings will function as an inlet and the opposite channel opening will function as an outlet and the path the airflow will travel will be the channel created by the dividers between the inlet and the outlet.

In one embodiment, the channel opening at the outside diameter of the vent is the maximum area of that channel opening. As wind blows toward the vent, it enters one (or more) of the channel openings (inlet) and moves down the channel that is formed by two dividers to either side of the direction of the airflow, and by the upper plate and a lower plate. As the wind moves down the channel from the inlet toward the center, the area of the channel gets increasingly constricted, in one embodiment, until a specific diameter away from the center of the channel is reached. At this point, the associated dividers can terminate. In one embodiment, the upper plate can include openings, called ports 46, that are located above each channel at a point of minimum constriction between the dividers. A check valve 34 can be placed on the top side of each port that only allows air from inside of the upper chamber to pass through the port to the channel and not in the reverse direction. In an embodiment with six ports, there can be six check valves, two for each channel, or more specifically, one per channel opening. As air flows down a channel from the inlet to the outlet, it picks up speed according to the Venturi principle, and at the point of minimum constriction diameter, which can be before or after it reaches the center of the vent, corresponds to where the port is disposed and these are the points where pressure in the channel will be the lowest causing air from inside the upper chamber to flow into the channel along with the air that is travelling through the channel from the inlet. As the air continues through the channel, it can reach the outlet directly in line with the path 44. Since the other two channels do not have wind moving through them, it is expected that the pressure inside those channels will be nearly the same as outside atmospheric pressure, which will be higher than the low-pressure created in the inlet side of the channel in which the air is moving down. Since the check valves only open when the pressure on the channel side is lower than the pressure in the bottom chamber minus the open pressure of the valve, the other check valves would not open. Therefore, it is expected that only one or two of the check valves will be open at any given time during times of high wind going through the vent. Those check valves will stay open and air will flow from upper chamber of the vent for a period of time for which the pressure inside the upper chamber of the vent minus the low-pressure created by the constricted airflow in the channel blowing past the channel side of the check valve, is greater than the open pressure rating of the valve. This will cause a "sucking" effect that will actually draw the roof membrane closer to the roof in times of high wind.

Figure 3C:
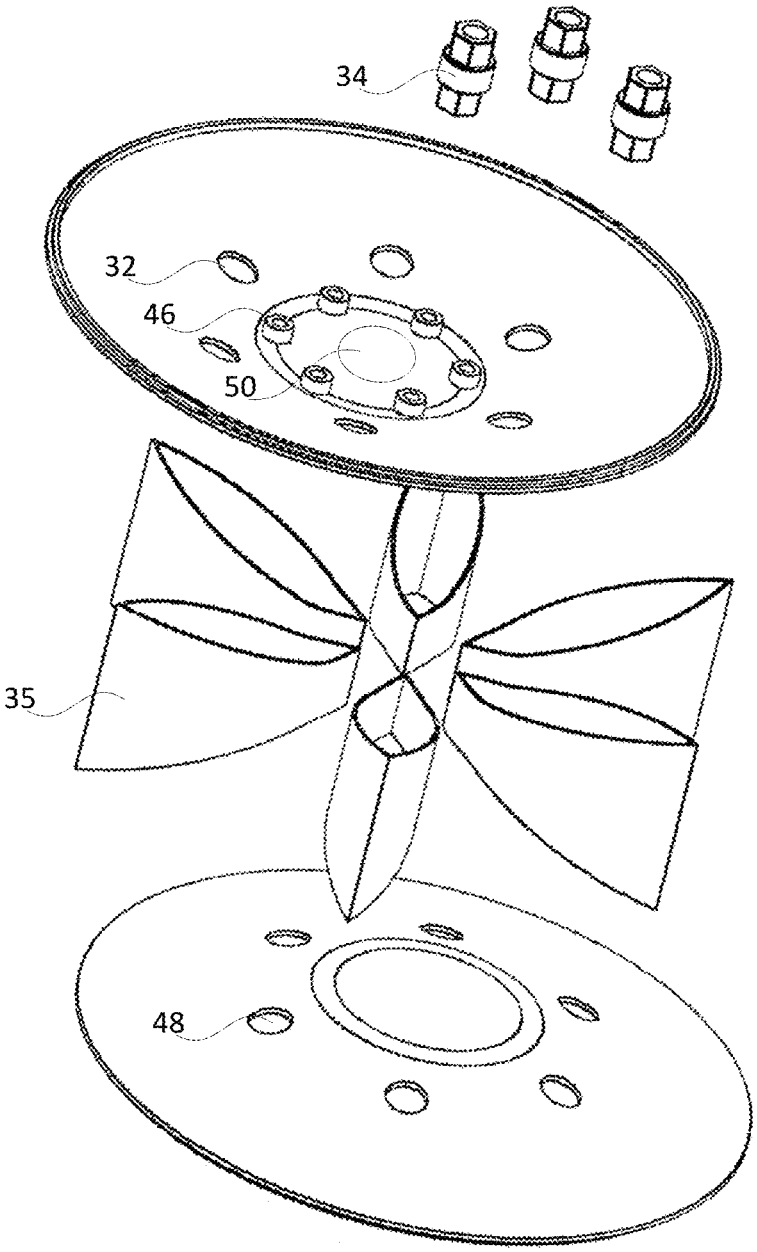
FIG. 3C is a perspective view of aspects of the invention.

Referring to FIG. 3C, the vent/channel section is shown in an exploded view having check valves 34 that receive air through the port 46. The upper and lower plate openings 32 and 48 allow air to flow between the lower section and the upper section through the dividers. In one embodiment, the dividers 35 have general airfoil cross section with walls defining a cavity. The air foil design of the dividers along with the slopes of the top and bottom plate, assist in creating the low-pressure area in the center of the vent/channel section.

Figure 4:
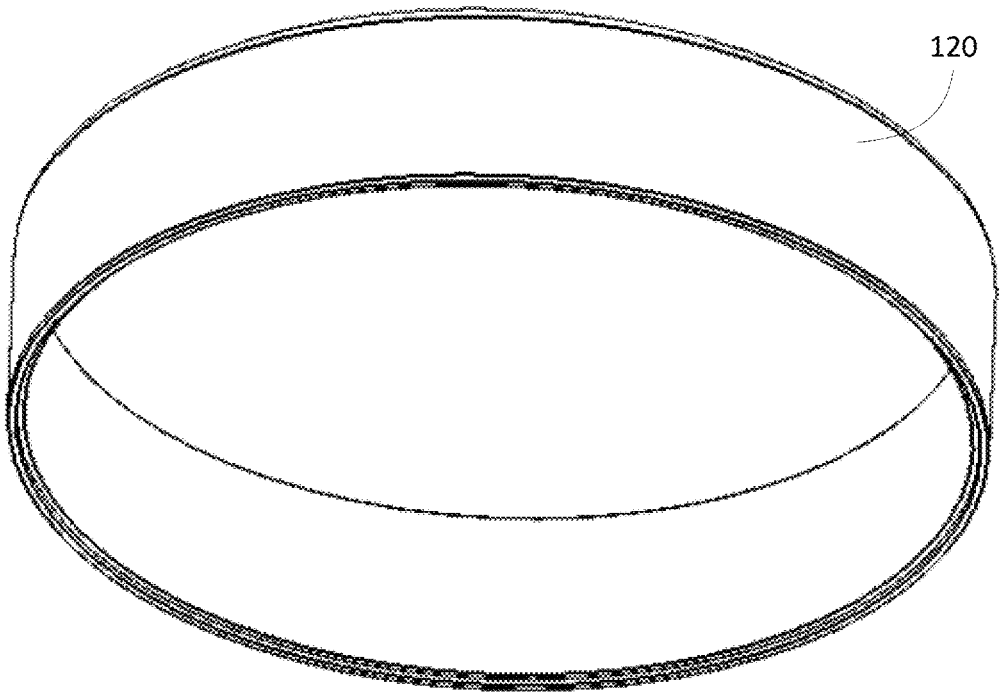
FIG. 4 is a perspective view of aspects of the invention.

Referring to FIG. 4, the upper section or cap 120 is shown that is received on the upper plate to seal the upper section so that the only fluid entering and leaving the upper section would be through the upper plate openings and the ports.

Figure 5:
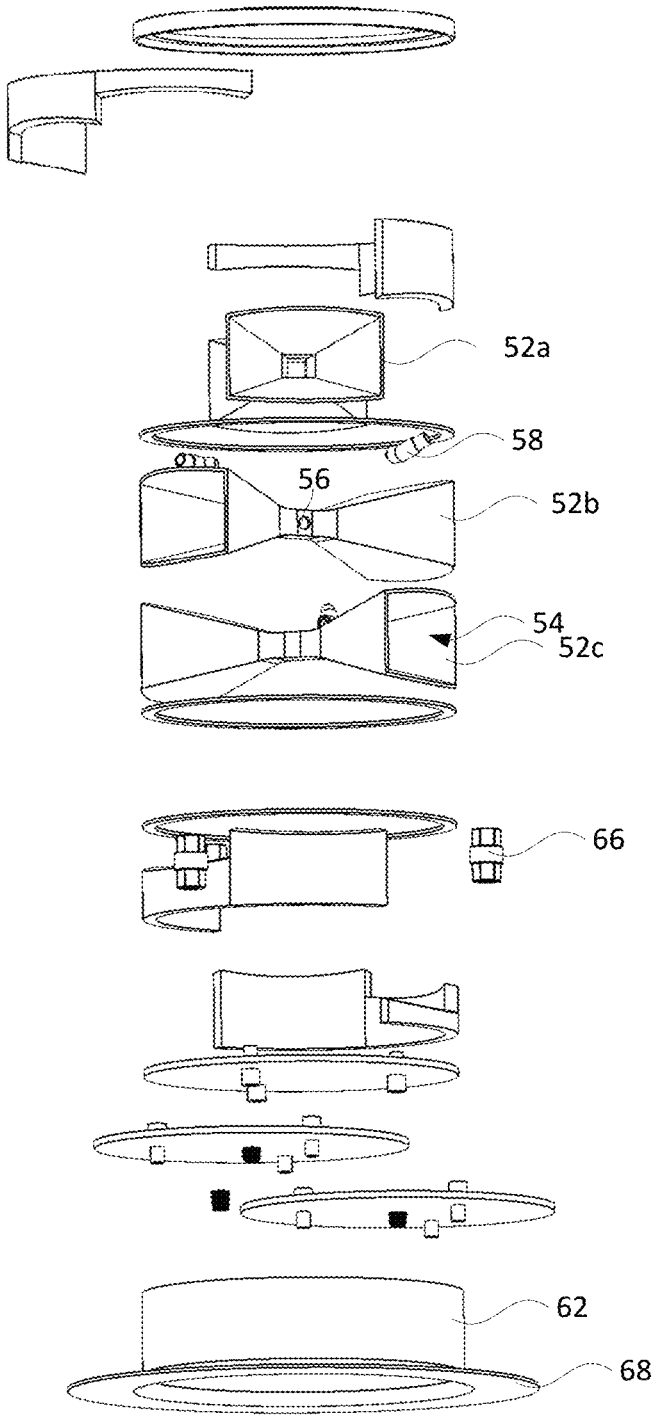
FIG. 5 is a side view of aspects of the invention.
Figure 6:
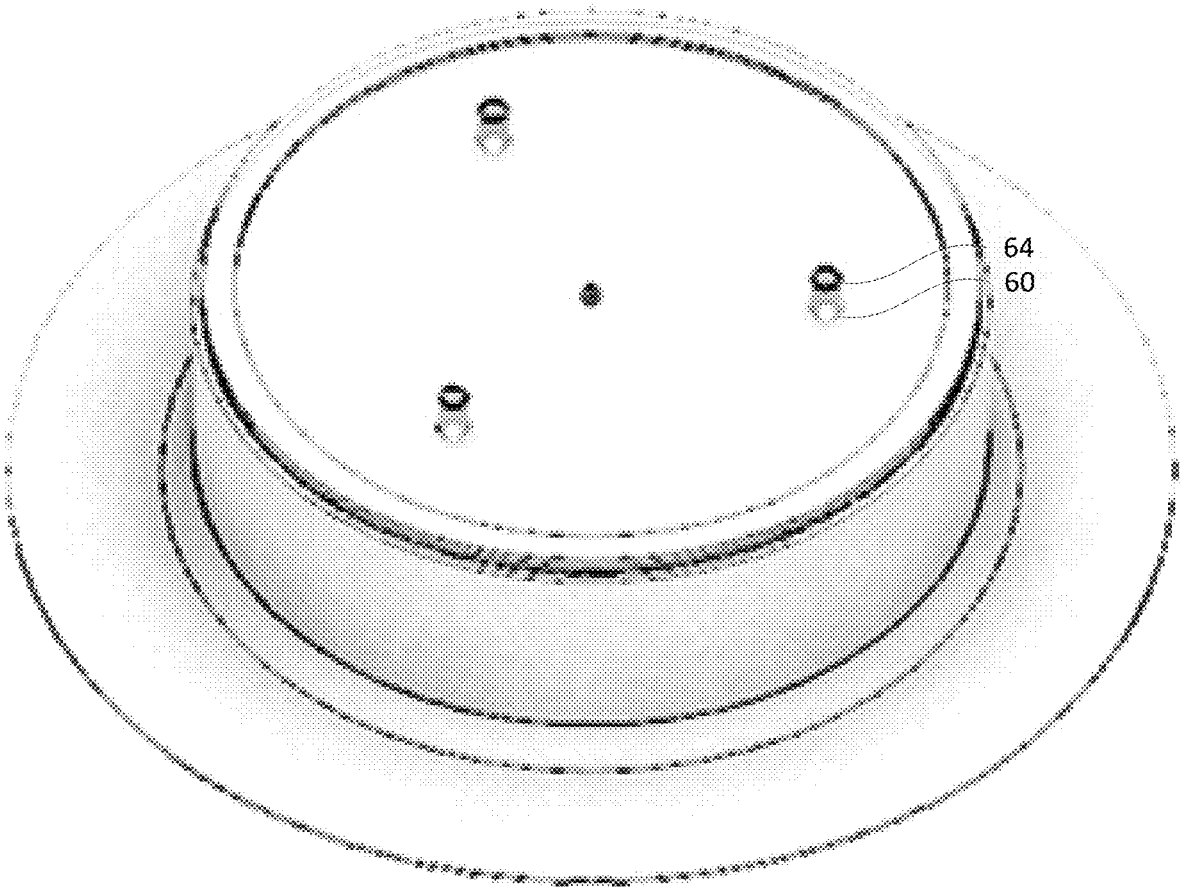
FIG. 6 is a perspective view of aspects of the invention.

Referring to FIG. 5, one embodiment of the present invention is shown. In one embodiment, a series of horizontal air ducts 52*a* through 52*c* placed circularly on the azimuth such that all 360 degrees of azimuth can have an opening 54, called a duct opening, facing any direction around the azimuth of the vent. Each horizontal air duct can have two duct openings that are disposed 180 degrees apart, in one embodiment, from each other. Each air duct can have airtight walls that are constricted toward the center such that the cross section of the area at the port is greater than the cross section of the area at the center. Each air duct can have a channel hole 56 placed on one of the walls at its center. The channel hole of each air duct can include a fitting 58 and is connected via a flexible air hose (not shown) to an opening 60 (BAC opening) (FIG. 6) in the bottom airtight chamber 62. Each BAC opening can have a fitting 64 (FIG. 6) on the top side such that the other end of the flexible air hose can be fitted to it. On the other side of each BAC opening, inside the bottom airtight chamber, can be a one-way check valve 66 that only allows air to pass from inside the bottom airtight chamber 62 to outside the bottom airtight chamber through the BAC opening and does not allow air to pass from outside the BAC opening into the bottom airtight chamber. Any air that passes through any of the check valves from the bottom airtight chamber is therefore passed to the outside of the vent through the flexible air hoses that connect between the bottom airtight chamber and the channel hole of any one of the air ducts.

In one embodiment, the NPV mode, wind travels into one or more of the air ducts (distal openings). As air travels from the outside through any one of the ports, it travels through at least one constricting air duct, toward the center point of that particular air duct. Each air duct can be constricted toward the center in such a way that air moving through it causes a Venturi effect in the horizontal air duct which, in turn, causes a low-pressure at the center point of the horizontal air duct, where the channel hole 56 for that horizontal air duct is located. Since each channel hole is connected to a check valve in the bottom airtight chamber via an airtight flexible air hose, when airflow in the air duct is sufficiently high enough, the low-pressure will be presented to the channel hole which is then, in turn, is presented to the connecting check valve in the bottom airtight chamber, creating a low-pressure on the topside (outside of the bottom airtight chamber) of that particular check valve (on the inside of the bottom airtight chamber). Each check valve inside the bottom airtight chamber will open when the low-pressure presented to topside of that check valve is at least the magnitude of the check valve's open pressure. Each check valve will stay open and air will flow from the bottom airtight chamber for a period of time until the air pressure inside the bottom airtight chamber minus the low air pressure created by the constricted airflow in the horizontal air duct is greater than the open pressure rating of the valve.

Since the flange 68 of the bottom airtight chamber of the vent can be airtightly sealed to the roof membrane, any air flowing from the bottom airtight chamber through the flexible hoses, through the check valves, through any of the channel holes, to the outside, is actually air flowing from under the roof membrane to the outside. In general, the stronger the wind flowing through any one of the air ducts, the lower the pressure presented to the topside of the check valve and hence the more the roofing membrane gets forced onto the underlying decking or roof system.

Figure 7A:
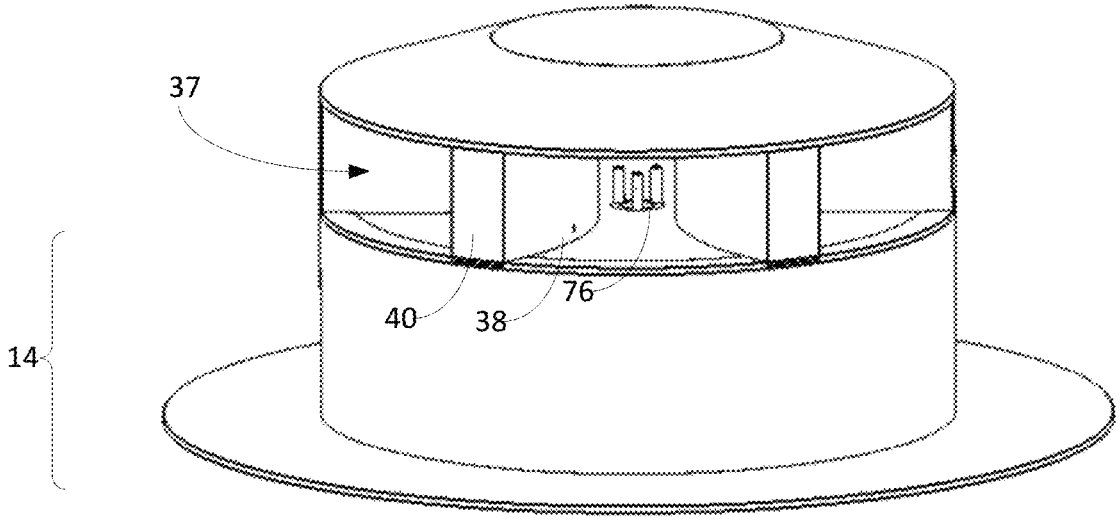
FIG. 7A is a perspective view of aspects of the invention.

In one embodiment, referring to FIG. 7A, an embodiment that has an air diverter instead of an upper chamber, is shown having 3 sections, namely the bottom chamber, the vent/divider section, and the air diverter/Top Plate/Cap. In one embodiment, there is no upper chamber since the check valves are located inside the dividers 38 on top of the bottom valve plate. The air diverter (not shown) diverts air from the bottom chamber that pushes through the check valve in the divider to the channel 76. The radius of the dividers and the pitch on the top and bottom valve plates can be modified to tune a vent to operate under specific wind speeds. In addition, the channel opening 37 can be reduced or enlarged on specific models to reduce or increase the amount of the airflow going through the channel.

Figure 7B:
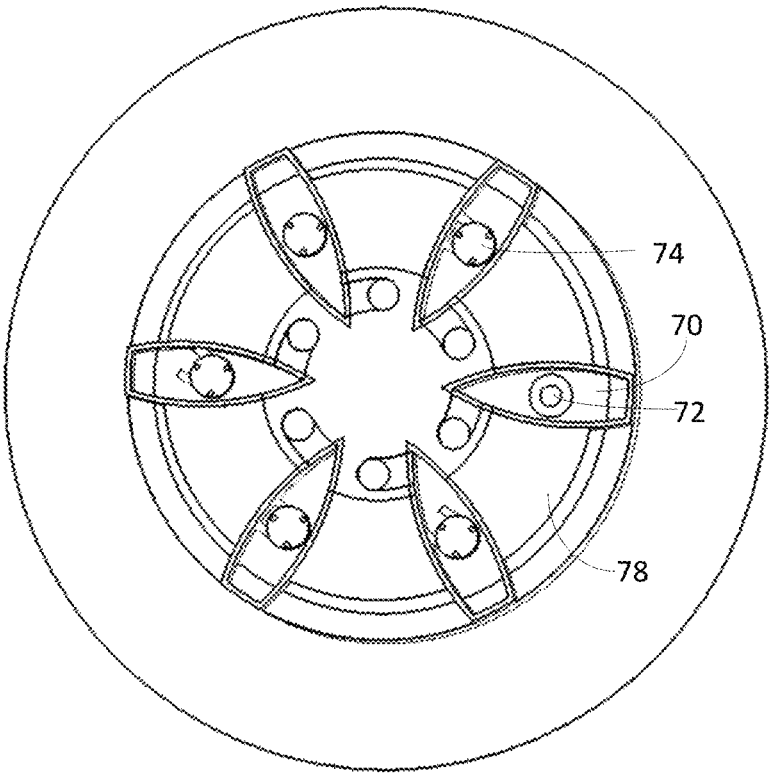
FIG. 7B is a top down view of aspects of the present invention.

Referring to FIG. 7B, the walls of the dividers can define voids 70 within each divider disposed in the vent/channel section. The voids can generally surround an opening 72 allowing fluid communications from the vent/channel section to the lower section. The opening can include a check valve 74 cooperatively arranged with the opening so that when a predetermined open pressure is achieved the check valve opens allowing air to flow from the lower section to the vent/channel section and be transferred to the exterior of the vent/channel section. The predetermined pressure can be achieved when the pressure in the lower section increases to the predetermined pressure. The predetermined pressure can also be reached when air flowing through any of the channels of the vent/channel section creates a low-pressure force above the check valve that, when a certain negative pressure is reached, the check valve opens. In one embodiment, the vent/channel section includes an air diverter 78.

Figure 7C:
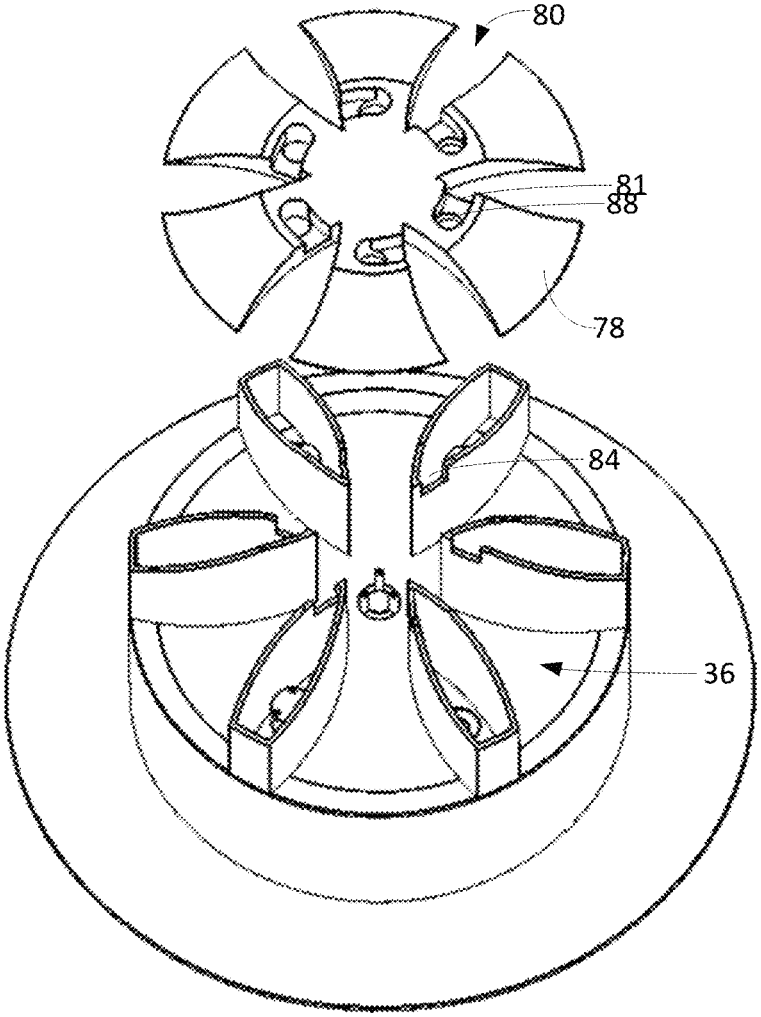
FIG. 7C is a perspective view of aspects of the invention.

Referring to FIG. 7C, the air diverter 78 is shown having a slot 80 that can receive the walls of the dividers. The air diverter can include a slot 81 that is operatively associated with a cutout 84 in the divider so that air flowing from the void into the divider can flow through the cutout 84 and into the channel 36. An opening, called the channel hole, 88 and at the end of the air passage 82 can be open to the channel 36 allowing air to flow from air passage 82, through opening 88 into channel 36 and out of the vent/channel section. A check valve located on the bottom valve plate inside each divider allows air to pass from the bottom chamber to the air passage 82 when a predetermined pressure of air is reached to open the check valve.

Figure 7D:
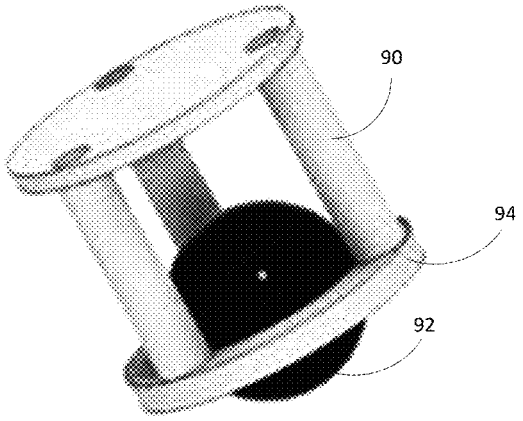
FIG. 7D is a perspective view of aspects of the invention.
Figure 7E:
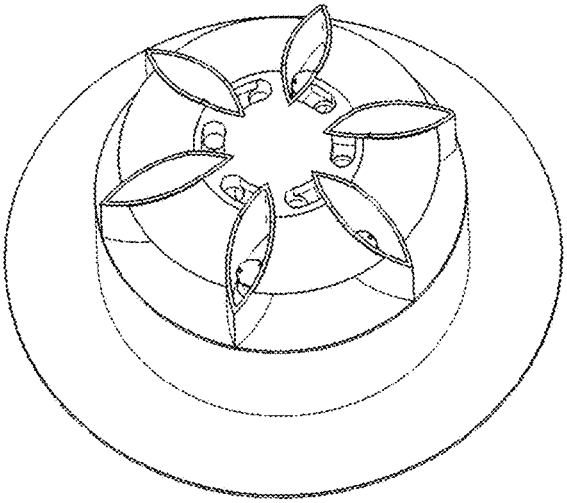
FIG. 7E is a perspective view of aspects of the invention.

In one embodiment, referring to FIG. 7D, one embodiment of a check valve is shown having a cage 90, ball 92, and seat 94. When sufficient pressure/predetermined pressure level is reached, the ball is released from the seat allowing air to follow through the cage and around the ball.

Figure 8:
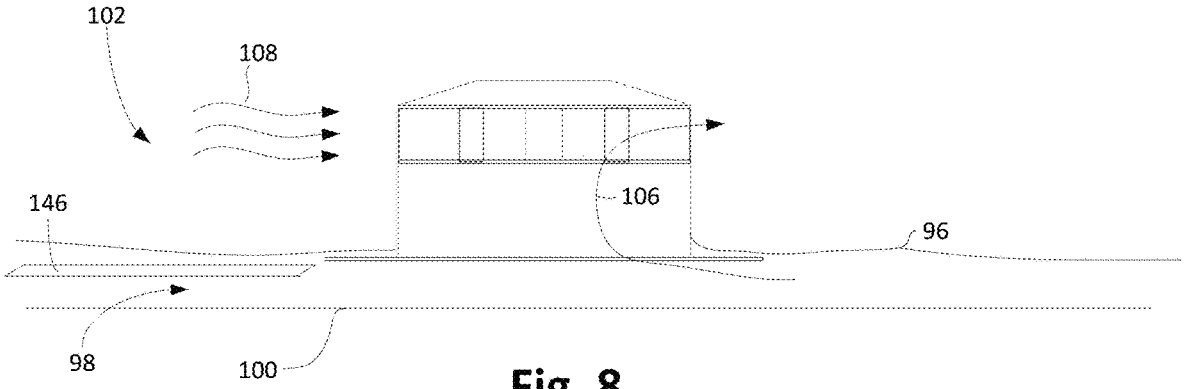
FIG. 8 is a side view of the invention.

Referring to FIG. 8, the vent is shown with the membrane 96 with flange 16 being disposed below the membrane and the remainder of the lower portion and the vent/channel section (and upper section on one embodiment) disposed above the membrane. An air space 98 can be defined between the membrane and the decking or roof 100. In one embodiment, one or more ribs can be disposed between the membrane and the decking or otherwise under the membrane so that a vacuum created by the invention does not seal the membrane around the flange and allow pockets to be trapped outwardly from the invention. The ribs can be solid, hollow with open later ends, perforated along its long axis, or any combination thereof.

In one scenario, air in the air space can be greater than the air pressure in the surrounding environment 102 so that there is an air differential between the air space and the outside environment generally outside the membrane. Pressure in the air space and potentially under the decking or roof can be released through the vent along path 106. In one embodiment, when wind, traveling along path 108 in one example, enters the vent, negative pressure is generated in the vent/channel section resulting in air being pulled from the air space, through the vent and above the membrane along path 106, for example.

In one embodiment, the invention includes the following features: a center tube, which optionally includes a center tube extension, connecting a base assembly at the bottom of the center tube to openings at the top of the center tube; a cap that air-seals the top of the center tube from the outside; one or more openings, near, or at the top, of the center tube which connects, in a fluid sense, to external extension assemblies or to internal check valve compartments for the purpose of flowing air from inside the center tube to the external extension assemblies or check valve compartments; one or more external extension assemblies or internal check valve compartments. The external extension assemblies for one embodiment serve the same purpose as the internal check valve compartments for one embodiment except that the external extension assemblies reside mostly outside the periphery of the center tube while the internal check valve compartments reside inside the periphery of the center tube or extension thereof. Each of the external extension assemblies or compartments are airtight cavities that only allows air to pass through them in one direction. The air coming into the cavity comes from the center tube and the air going out of the cavity goes out to a downward facing exterior opening, called a port, which is on, or some distance away from, the periphery of the center tube. This one-way directional airflow is achieved inside each external extension assembly or internal compartment by the use of an air check valve, which resides inside the external extension assembly or internal compartment, that only allows air to flow from its input opening, i.e. from the center tube, out to its output opening, i.e. to the port. The check valve greatly restricts air from flowing in the other direction (i.e. from the port to the center tube). For embodiments that use external extension assemblies instead of internal compartments, the external extension assemblies may or may not be mounted to a horizontal plate extending out from the center of the center tube for extra stability.

One or more openings, called ports, around the periphery of the center tube positioned to take advantage of areas of low-pressure around the periphery of the center tube when wind is present. Each port can be in fluid communications to external extension assemblies or check valve compartment.

For some embodiments that employ external extension assemblies, vertical engagement tubes are used which are tubes of any shape that protrude vertically down from the opening of the external extension assembly to extend the port downward, into the horizontal air stream to create higher velocity airflow, resulting in lower pressure at the port openings.

A screen outfitted at the port to keep debris, bugs, etc. from entering the port from the outside.

A base assembly can include a hollow vertical stem of a diameter that fits inside the bottom of the center tube and on which the center tube rests, to be affixed in place by cement weld, screw threads, or other means of assuring an airtight secure seal to the center tube; a base flange of sufficient thickness for stability that extends outward in a mostly horizontal direction from the outside diameter of the stem out to the outside dimensions of the base assembly; and feet/spacers that the base flange rests on. The base flange and spacers may rise slightly in the vertically direction from the outside dimensions of the stem to the outside dimension of the base assembly to assure that the airflow area between the roof deck and the base flange at any radius from the outside diameter of the stem out to the outside dimension of the base assembly is greater than or equal to sum of the cross-sectional area of the inside diameter of the stem. In addition, the base may or may not have a backflow inhibitor check valve that would be placed inside the stem to inhibit airflow into the space under the membrane in the event of a broken vent. The backflow inhibitor check valve would allow air to flow from the membrane to the center tube but would greatly inhibit airflow in the opposite direction.

An external flexible boot that consist of a vertical section called the boot tube and a horizontal flange that is larger than the base flange of the base assembly. The flexible boot is made of a material that can be airtight sealed to the top of the particular roof membrane usually by thermoplastic weld. The diameter of the boot tube is slightly larger than the outside diameter of the center tube such that it can be slid over the center tube and airtight sealed to the center tube by means of clamps, shims, caulking and other methods that can assure an airtight seal to the center tube and to the membrane with the only air paths being a one-way air path from under the membrane, through hollow portion of the base assembly and center tube, through the check valves, and out the ports to the outside.

Figure 9:
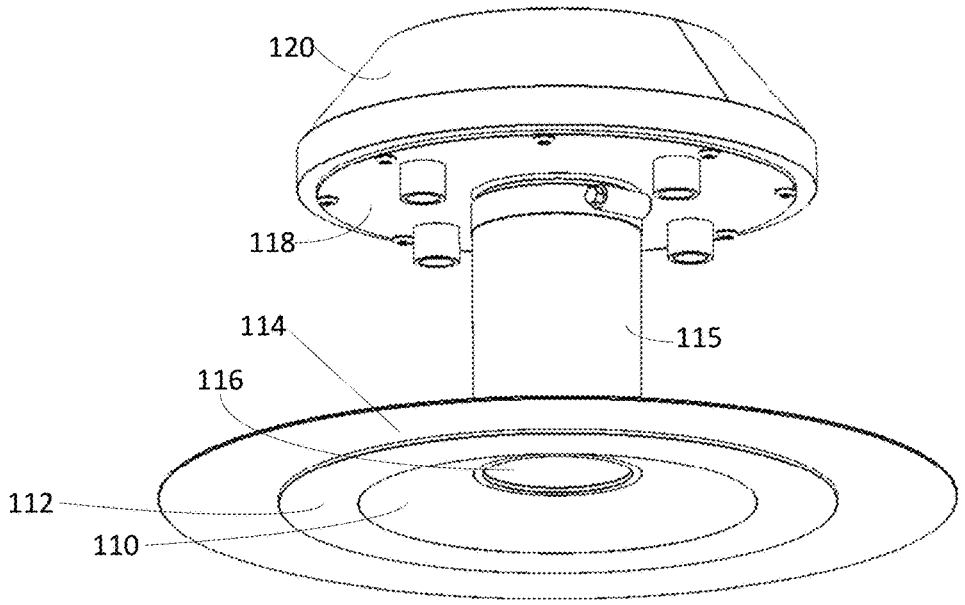
FIG. 9 is a perspective view of aspects of the invention.

In one embodiment and referring to FIG. 9, a base assembly 112 can include a flange 110 that gives assistance with vertical stability. The flange of the base assembly can be inserted into an opening in a roof membrane so that it is disposed on the rooftop and can be on the underside of the roof membrane. A membrane boot 114 can be one or more pieces that can fit over the base flange and around the center tube 115 and can be adhered to the roofing membrane and to the center tube to provide an airtight seal between the vent and a space below the roof membrane. The membrane boot can be airtight sealed to the topside of the roof membrane and to the center tube. These components can be cooperatively associated and work together to provide fluid communications between the invention and the air space defined between a roof membrane and decking or roof system. A center tube, 115 can provide structural integrity to the vent assembly and provides an airway between external extension assemblies that can be disposed on a top plate 118 for stability and under a cap 120 for an airtight seal and weather protection.

Figure 10:
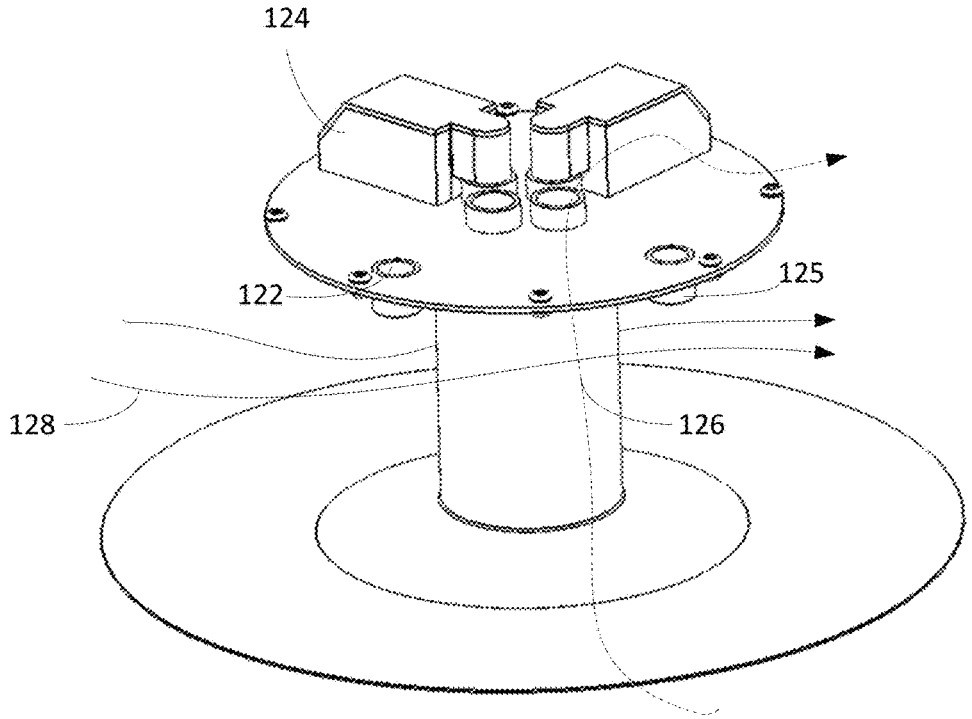
FIG. 10 is a perspective view of aspects of the invention.

Referring to FIG. 10, the top plate 118 can include openings to the center tube 122 and a plurality of perimeter openings, called ports, such as 122. A external extension assembly 124 which contains the one-way check valve can be disposed on the top plate that provides one-way flow 126 from the roof side of the invention, through the center tube, through the check valve, and out one of the ports 122 through the vertical engagement tube 125. The check valves can include a one-way valve such as a diaphragm that allows air to pass in direction 126, from below the membrane and through the center tube to the outside through the port but not in a reverse direction. In one embodiment, a vertical engagement tube 125 can extend the port into the air stream 128 which, can pass underneath of the top plate producing a higher velocity airflow at or near each port opening creating lower pressure at the port opening which can act to draw air from underneath of the roof membrane, through the center tube, through check value, and out the port through the vertical engagement tube.

In operation, air can travel in one direction from between the roof deck and the membrane to the outside through an equalization mode. The equalization mode occurs when the air pressure between the deck and the membrane, in proximity of the vent/baseplate, exceeds the air pressure above the membrane. Air travels from between the roof deck and membrane through the center tube through the one-way check values, and to outside through the ports. Air will continue to travel in this manner until the pressure below the membrane is at or near the outside ambient pressure. The weight of the membrane can assist in that it can add pressure to any air that may leak into the space between the membrane and the roof deck, thereby forcing the air out of any nearby vents.

Figure 11:
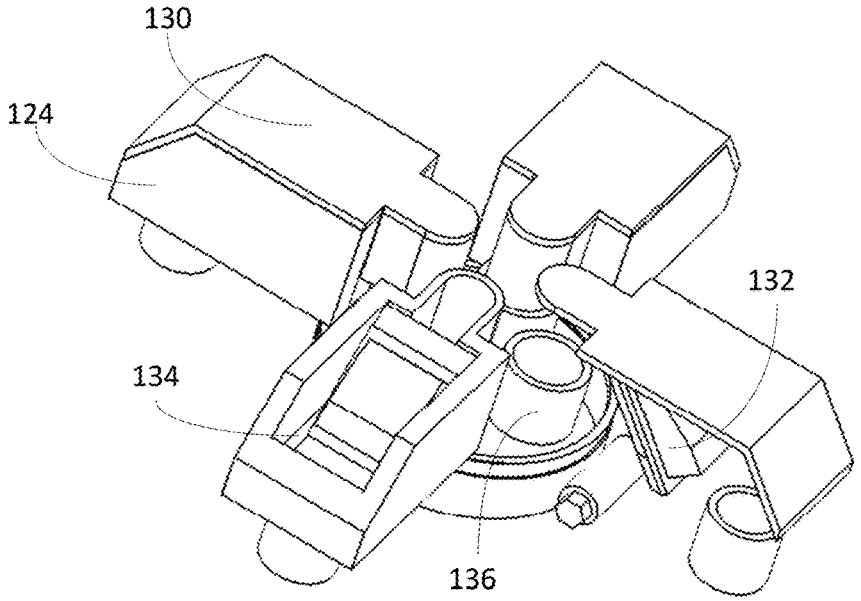
FIG. 11 is a perspective view of aspects of the invention.
Figure 12:
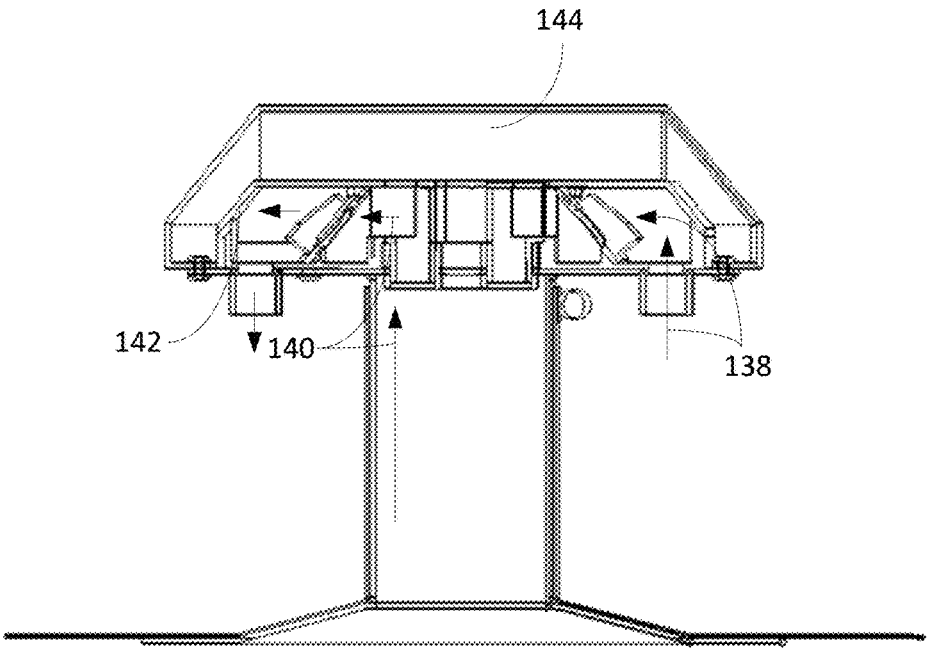
FIG. 12 is a side cut away view of aspects of the invention.

Referring to FIG. 11, the external extension assembly 124 is shown with a top cover 130 removed. The valve 132 itself is disposed under the top cover 130 and above a floor 134. The center tube can be in fluid communications with internal openings 136 allowing air to flow from under the roof membrane, through the center tube, into the external extension assembly 124. Referring to FIG. 12, when air attempts to back flow in a direction shown as 138, the valve is forced into a closed position preventing air from flowing into the external extension assembly. When air flows in a direction shown as 140, the valve is opened, allowing air to flow around the valve and out of the port 142. In the top cover, there can be a space 144 that can include a filler such as foam, electronics that can be used to measure moisture, air flow volume and rates, temperature, and the like. The measured information can be transmitted to a computer or electronic storage device, connected wired or wireless, for subsequent review and/or analysis. The space can be disposed above the check valves and/or between the check valves.

In one embodiment, a vent can be made from any number of materials and can include a downward facing tube that extends the port down into the horizontal airstream (e.g. a vertical engagement tube) and can be located near the periphery of a top plate (circular, rectangular, square, and the like) that is disposed above a roof. The vertical engagement tubes are hollow and can face 90° to the ambient flow (wind). When sufficient air flow passes by each vertical engagement tube, a low-pressure is created inside the vertical engagement tube. This vacuum can evacuate air located between the roof membrane and the roof deck. A one-way, airtight, pathway from between the roof membrane and the roof deck can be provided. Further, the invention can evacuate moisture that is present between the roof membrane and the roof deck by creating airflow from between the roof deck and membrane to the outside when there is sufficient air flow. Therefore, moisture can be drawn from under the roof membrane and outside the invention. The vertical engagement tubes can be spaced at sufficient distance from the perimeter of the center tube to facilitate generation of low-pressure at the port openings at the bottom of the vertical engagement tubes regardless of the direction of the wind. The base assembly can be used to stabilize the vent and to communicate low-pressure from the check valves to the underside of the roof membrane by locating the flange of the base assembly underneath of the roof membrane. A weather tight seal can be used to affix the invention to the roof membrane and can include a one-piece membrane boot whose flange can be thermoplastically welded to the roof membrane and whose vertical boot tube can be air-sealed to the outside diameter of the center tube. In one embodiment, one or more worm gear clamps can be used to adhere the vent to a membrane by allowing the membrane boot to be affixed to the vent during the fabrication of the vent as opposed to being affixed to the vent in the field.

Figure 13:
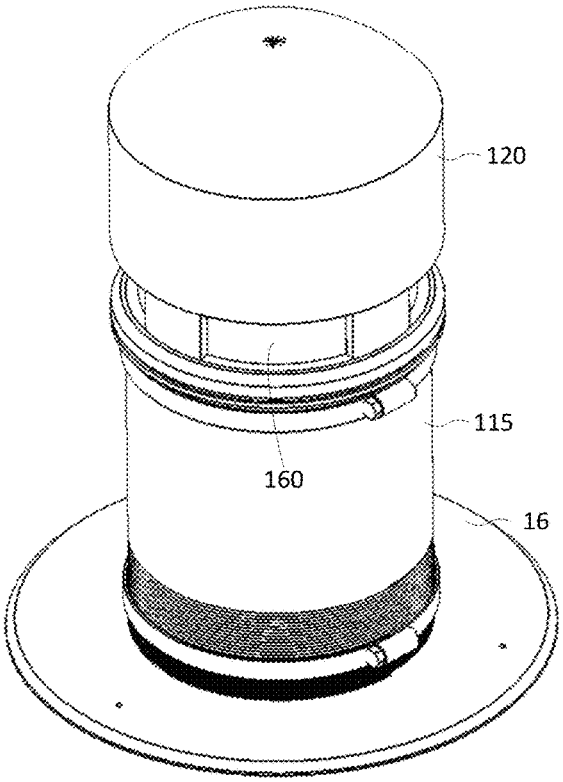
FIG. 13 is a perspective view of aspects of the invention.
Figure 14:
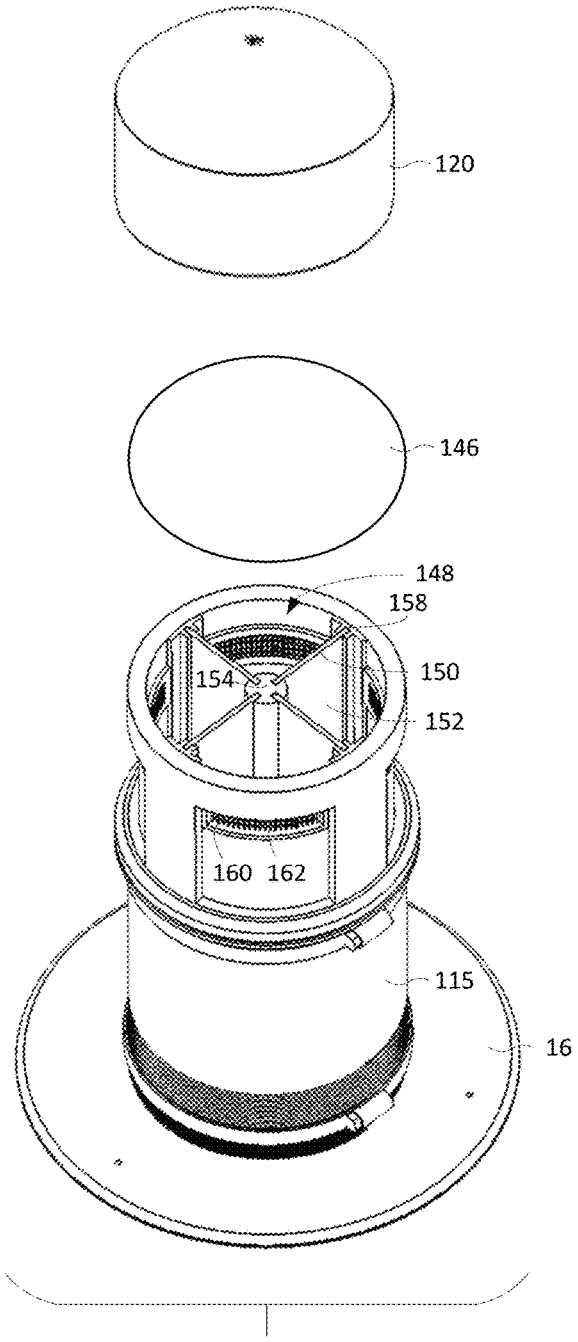
FIG. 14 is a perspective exploded view of aspects of the invention.
Figure 22A:
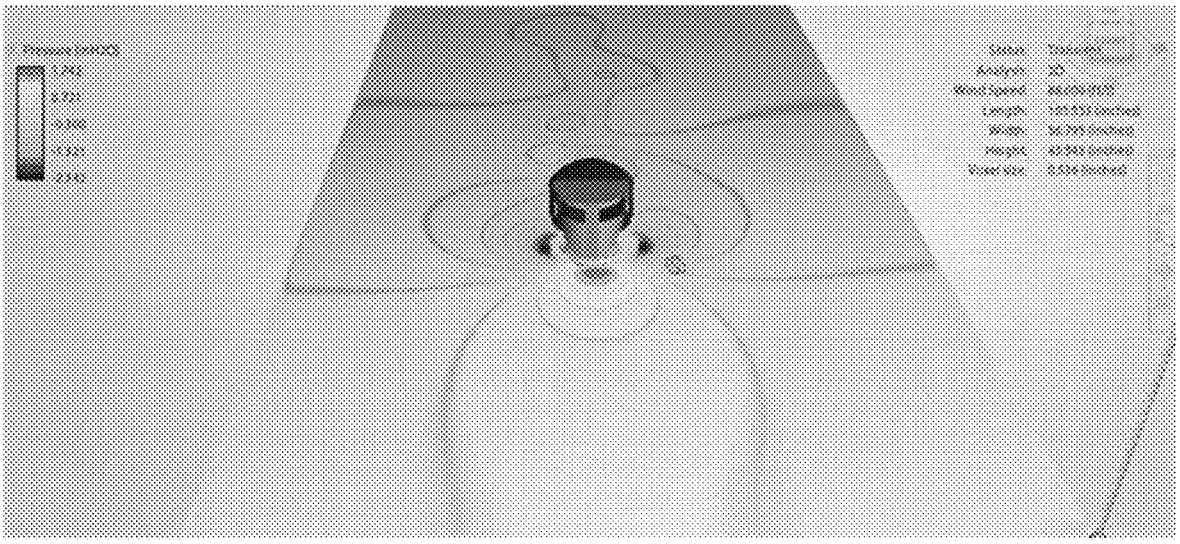
FIG. 22A is a graphical representation of the physical properties provided by the present invention.
Figure 22B:
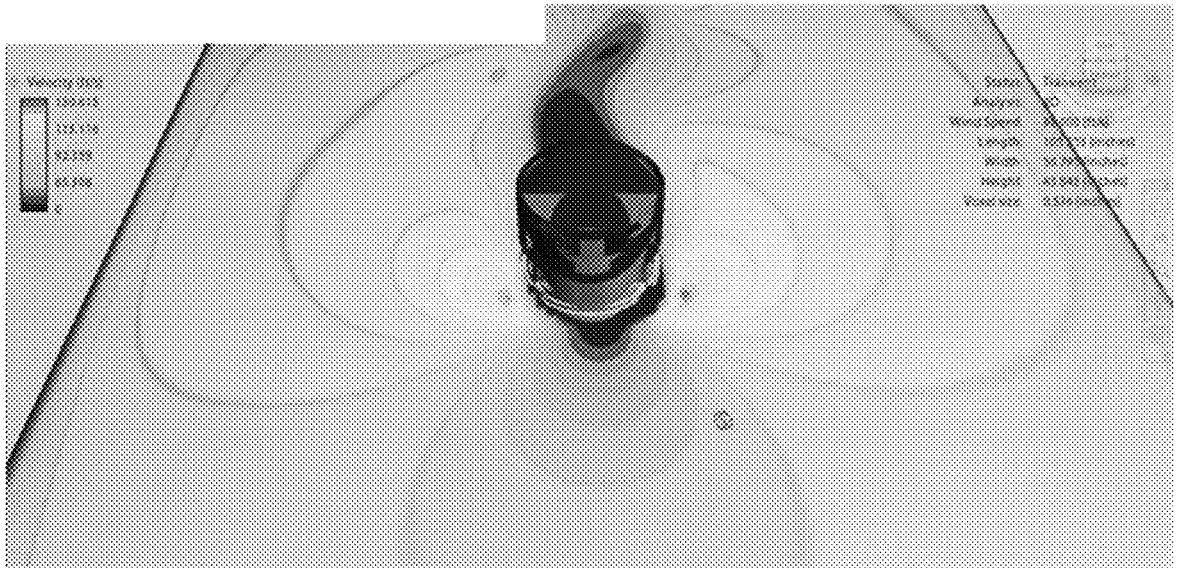
FIG. 22B is graphical representation of the physical properties provided by the present invention.

In one embodiment and referring to FIGS. 13 and 14, there is a center tube extension 148 that is affixed on top of the center tube. The center tube extension is divided into four airtight compartments by means of a separator assembly 150, 152, 154 that, along with a bottom plate (not shown) and top plate 146, keeps the compartments airtight from each other. Each compartment has two openings. One at the outside wall, called the port 160, and the other opening on the bottom plate which opens to the center tube 115 below. There is a check valve that sits over the opening on the bottom plate which only allows air to flow from the center tube into the compartment and to the port through the check valve and does not allow air to flow in the other direction. The outside edge of each port is recessed into the body of the center tube extension and defines recessed area 160. The port opening within the recessed area can include a screen 162 to prevent debris from entering the cavity. There can be a cap 120 that fits over top of the center tube extension and extends down far enough to cover slightly below the port opening to keep wind and rain from entering the port. Since each port opening is recessed as shown, there is sufficient airgap between the cap and the recessed center tube extension to allow each port to be open to the outside. The base assembly 16 can be fitted to the bottom of the center tube whose flange can be disposed under the membrane to rest on the roof deck on spacers to provides stability and airflow to the center tube. There could also be a flexible boot (not shown) of a material that could be adhered to the top of the roofing membrane as well as to the outside diameter of the center tube to provide an airtight seal to the membrane. When wind engages the embodiment, faster moving air left and right of the embodiment as shown in FIG. 22B create low-pressure zones at those points as well as shown in FIG. 22A. Depending on the orientation of the vent to the direction of the wind will determine the magnitude of the negative pressure that gets presented to underneath of the membrane.

Figure 15:
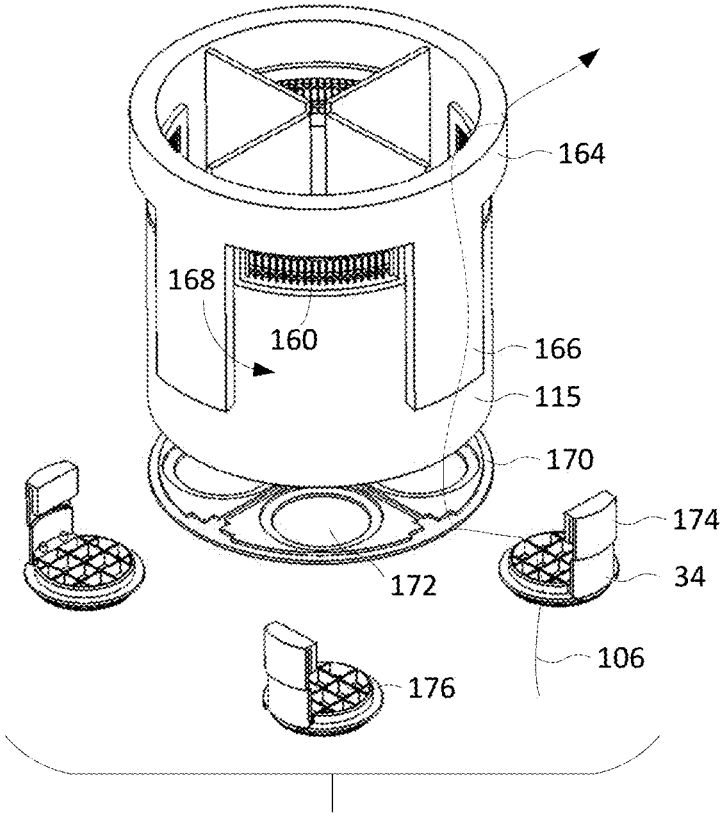
FIG. 15 is a perspective exploded view of aspects of the invention.

Referring to FIG. 15 for a more detailed description of the check valves inside each compartment of the center tube extension of the embodiment above. A bottom plate 170 can be carried by the center tube or included in the center tube and can include valve openings 172 for each compartment. One-way check valves 34 can be carried by the bottom plate so that they are disposed in the air flow path between the underneath of the roof membrane and port of each compartment. The one-way check valve can allow air to travel in a direction shown as 106 without it traveling in the reverse direction. The one-way check valves can include a check valve membrane (not shown), a check valve top 174 and grate 176. The check valve membrane is a flexible material that is sandwiched between the check valve top and the grate and only allows air to flow from the center tube to the port on the side of the upper check valve and does not allow air to flow in the other direction.

Figure 16:
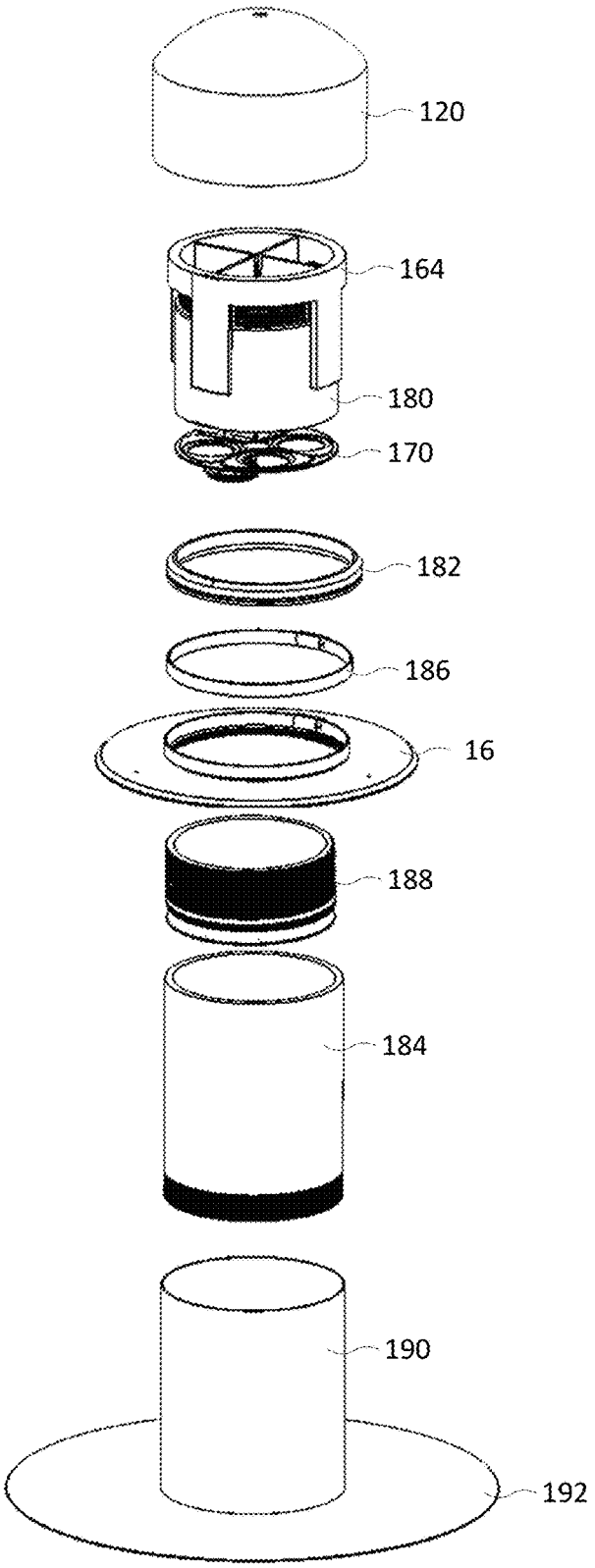
FIG. 16 is a perspective exploded view of aspects of the invention.

Referring to FIG. 16, the cap 120 is shown above center tube extension 180 with recessed portion of center tube extension 164. The bottom plate 170 is shown positioned below the center tube extension. A drip ring 182 can be positioned at the upper end of the center tube to protect boot 190 from rain infiltration. Center Tube extension 180 can be received into center tube 184 with recessed portion center tube extension 180 being received into center tube 184. Center tube can be received into flexible boot 190. In one embodiment, the tube extension can be tube 115. The Base flange 16 can be attached to the tube extension with its perimeter disposed under the membrane. Flange of flexible boot 192 can be sealed to the top of the membrane to provide air seal of the vent to the membrane and in one embodiment to assist with water resistance when the invention is installed on a roof.

Figure 17A:
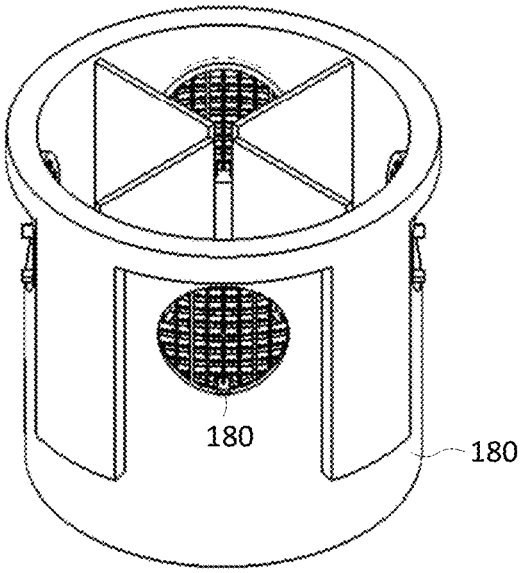
FIG. 17A is a perspective view of aspects of the invention.
Figure 17B:
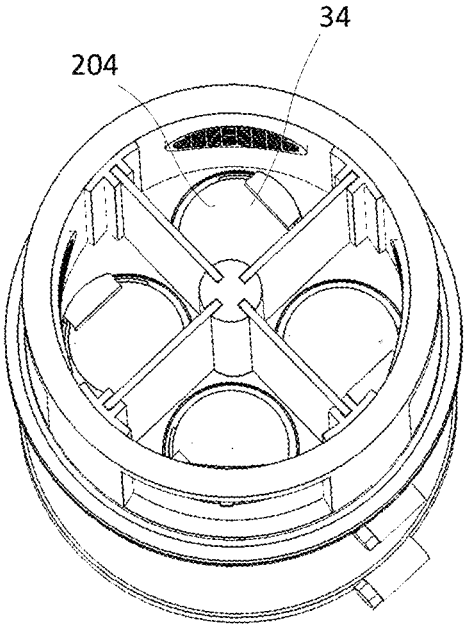
FIG. 17B is a perspective view of aspects of the invention.
Figure 18A:
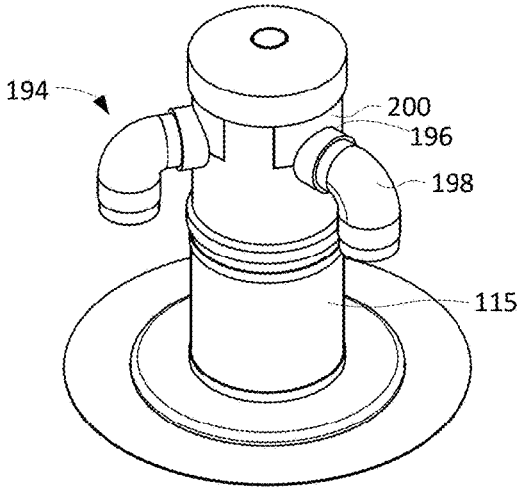
FIG. 18A is a perspective view of aspects of the invention.
Figure 18B:
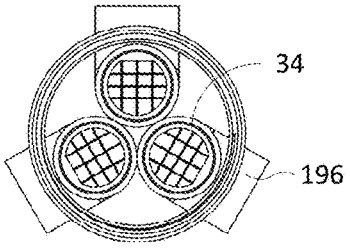
FIG. 18B is a bottom view of aspects of the invention.
Figure 18C:
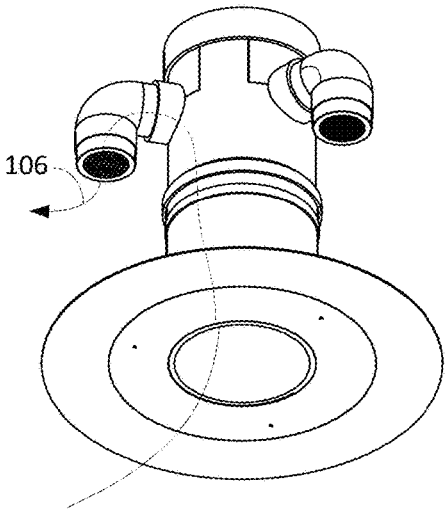
FIG. 18C is perspective view of aspects of the invention.
Figure 18D:
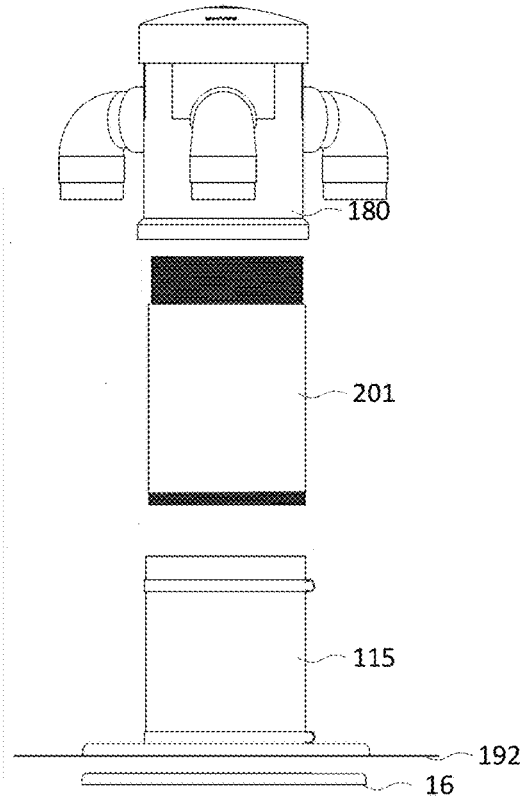
FIG. 18D is a side exploded view of aspects of the invention.

Referring to FIGS. 17A and 17B, one embodiment of the invention is shown with upper tube 180 wherein the port 160 can be circular as defined the upper tube. The port can include a grate. In one embodiment, the one-way check valve 34 is disposed in the cavity and within a sub cavity and can include a flap 204.

Referring to FIGS. 18A through 18D, one embodiment shows a center tube extension 180 that is received by the center tube 201. The center tube extension can have three external extension assemblies 194, 196 that are located equiangular around the outer diameter of the center tube extension. The external extension assembly can include two 90° elbows, one 90° facing external 194 and the other facing inward 196. The two elbows are connected in an airtight manner. A plate 200 which is secured is used to assist in assembling the external extension assembly into center tube extension 180. The opening of the 90° elbow exterior of the center tube extension is called the port. The opening of the 90° elbow interior of the center tube extension faces downward. A check valve 34 is fitted into each downward facing elbow interior of the center tube extension. Each check valve allows air to pass from the inside of the center tube 201 to the respective port when the pressure at the respective port is lower than that of the pressure inside of the center tube. Each check valve only allows air to flow from inside the center tube to the outside through the port as shown by path 106, and not the other way around. In one embodiment, the port/distal end of the external extension assembly can include a screen.

In one embodiment, the base flange can be disposed under the membrane or adjacent to the roof structure. The flange of the flexible boot 115 can be adhered to the top of the roof membrane and the stem of the flexible boot can be adhered to outside of center tube 201 to provide an airtight seal between the membrane and the vent. When there is a pressure at one of the ports that is lower than the pressure inside of the center tube, air flows from the under the membrane, through the center tube, through the one-way check valve and out the port along a direction shown as 106. Since the check valves operate independently, this airflow could happen at one or more ports.

Figure 19A:
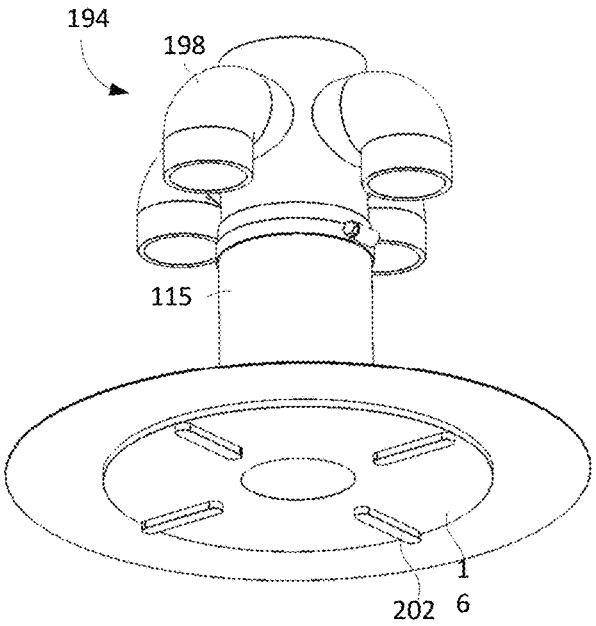
FIGS. 19A and 19B are perspective views of aspects of the invention.
Figure 19B:
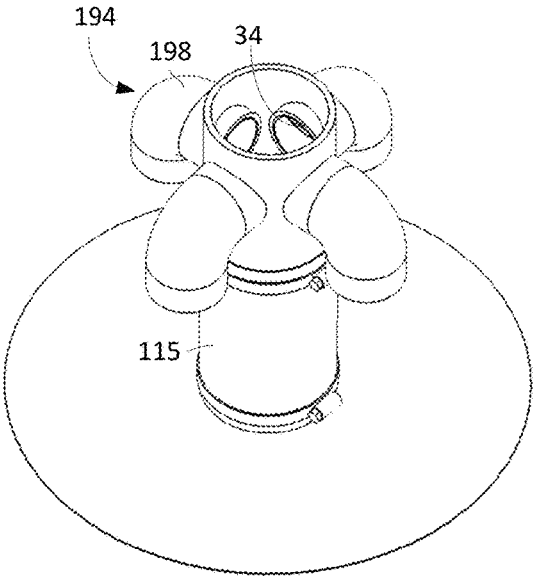
Figure 19C:
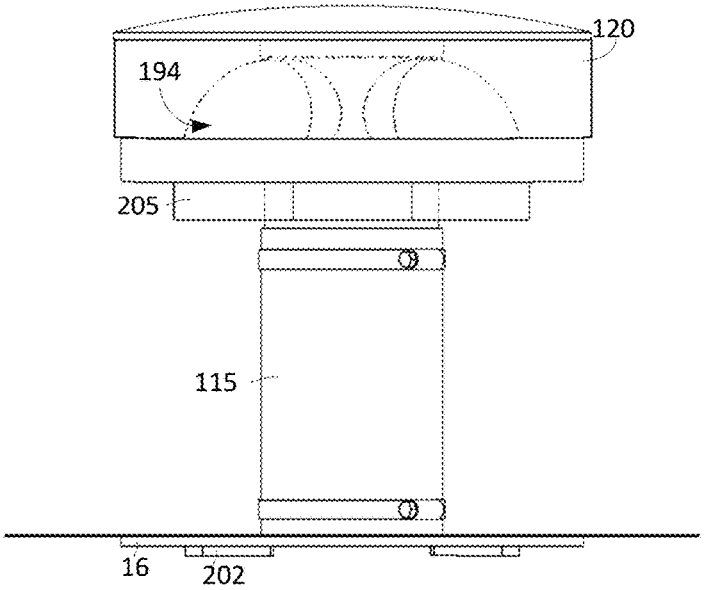
FIG. 19C is a side view of aspects of the invention.
Figure 20A:
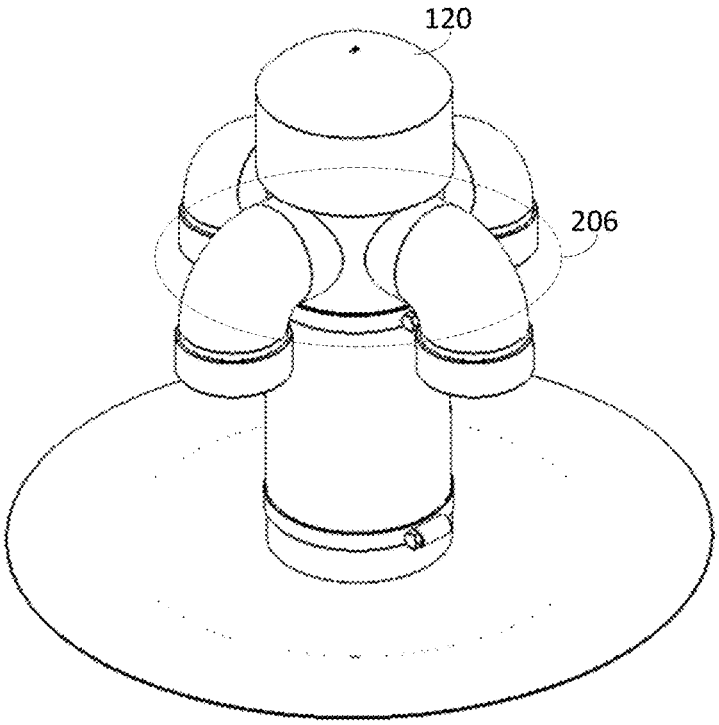
FIG. 20A is a perspective view of aspects of the invention.
Figure 20B:
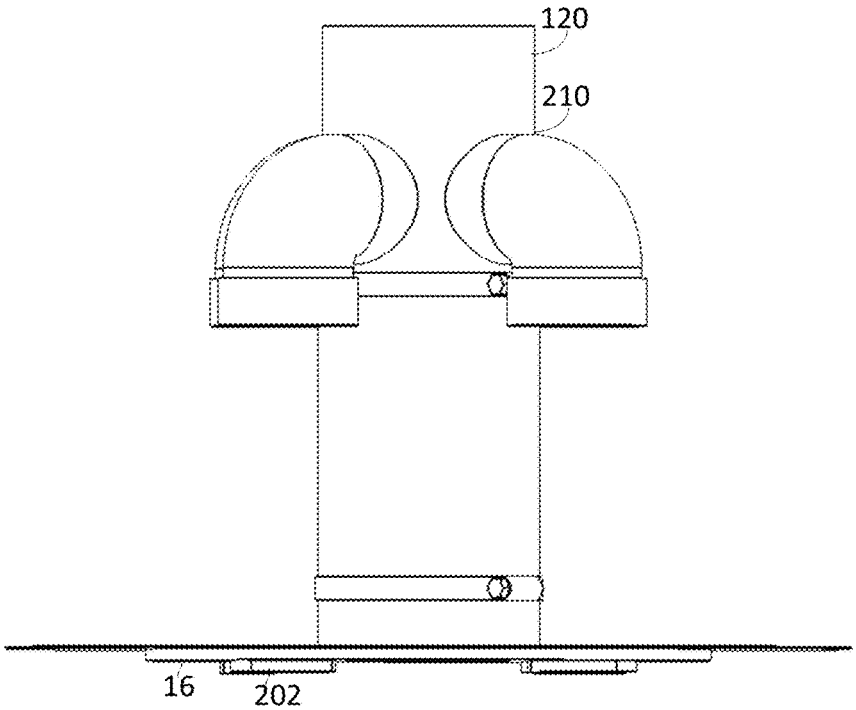
FIG. 20B is a side view of aspects of the invention.

In one embodiment and referring to FIGS. 19A through 19C, the external extension assembly 194 can include elbow 198 having a portion extending from the side surface of center tube 115. The external extension assembly can include a one-way check valve 34. The one-way check valve can be disposed within the external extension assembly or at one of its ends. Multiple external extension assemblies can be disposed around the center tube 115 and each having a one-way check valve where the one-way check valves can operate independently. Each external extension assembly is airtight sealed to center tube 115. The center tube is affixed to the base assembly 16 that sits under the membrane. The base assembly 16 can include a spacer 202 to lift the base assembly over the roof structure to facilitate air flow from under the membrane and into the tube and defining an air channel between the roof system and the base assembly. A cap 120 can be disposed on top of the tube above the top most portion of the external extension assemblies. A lower portion 205 of the external extension assembly 194 can extend down the port opening vertically into the moving airstream with the port being at the bottom. This lower portion can be considered the vertical engagement tube and is used to create higher velocity airflow, resulting in lower pressure at the port opening. Referring to FIGS. 20A and 20B, the cap 120 can be disposed on the top of the center tube, but have a diameter that is less than the area 206 defined by the outer edge of the external extension assemblies. A center tube top portion 120 can extend above the attachment point 210 of the external extension assembly to the side surface of the center tube sufficient to support the cap above the external extension assembly attachment point.

Figure 21A:
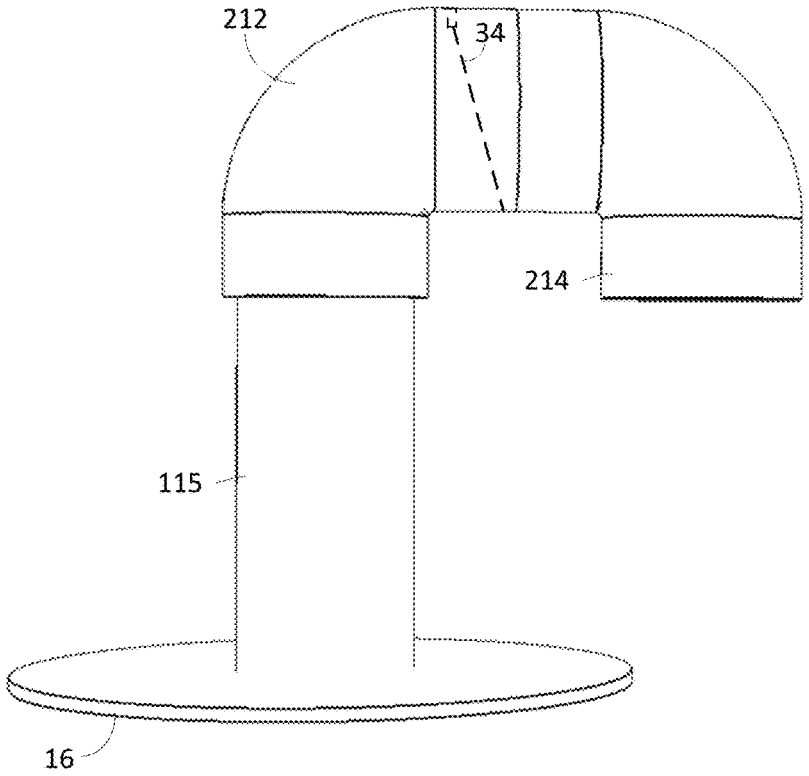
FIGS. 21A and 21B are side views of aspects of the invention.
Figure 21B:
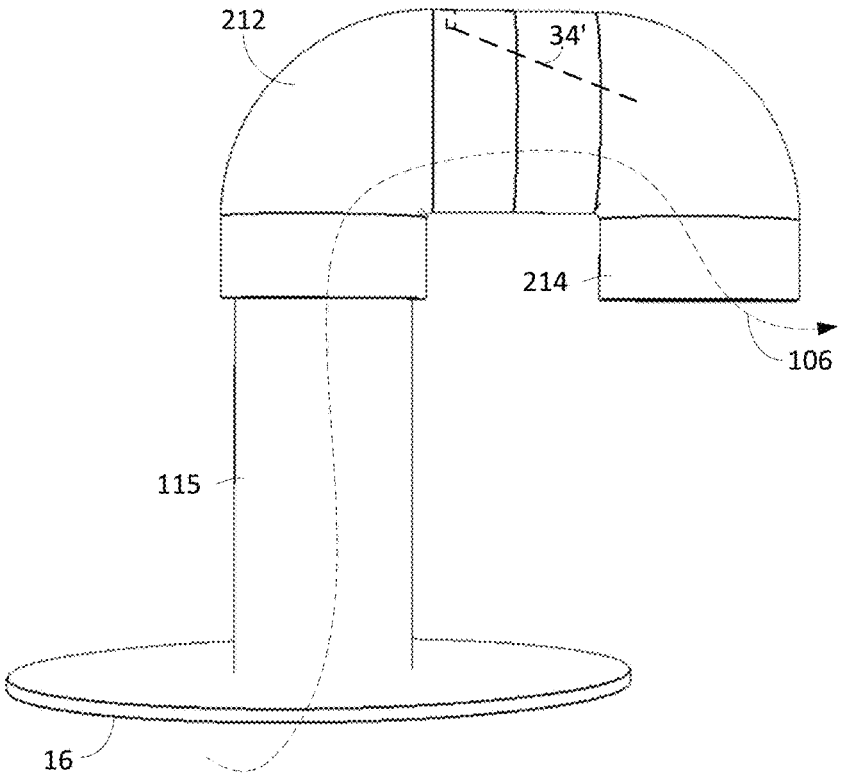

In one embodiment, and referring to FIGS. 21A and 21B, the base assembly 16 can be carried by the center tube 115 extending upward from the base assembly. The center tube can be in fluid communications with an air space disposed under the roof support structure or membrane. A first elbow 212 can divert the flow path traveling inside the tube. A distal opening 214, also called the port, can be disposed along the air flow path so that when ambient air flows across the opening at sufficient enough velocity, the one-way valve 34 opens causing air to flow from the membrane and/or roof support structure through the tube and out the opening. The lower portion of elbow 214 can be considered the vertical engagement tube to create higher velocity airflow, resulting in lower pressure at the port opening. The one-way valve can be disposed within the tube, elbow or otherwise along the air flow path. The one-way valve is shown as 34' in the open position with air flow path 106. The distal opening can be included in an external extension assembly configured to draw fluid from the roof system through the tube out the distal opening due to an efflux of external fluid across the distal opening.

Referring to FIGS. 22A and 22B, the functionality of one embodiment of the invention is shown with fluid flow results. As shown, there are low-pressures disposed on the left and right of the invention when the wind speed is approximately 60 mph (88 ft/sec). The minimum pressures shown left and right of the invention are about −2.34 inH20 or −0.08 PSIg in these results. When presented to one or more of the outer openings, a low-pressure zone is created that can cause the corresponding one-way check valve to open to draw air from underneath the membrane or roof structure. This low-pressure is created due to the increased wind speed to the left and right of the invention and can be at least partially described by the following:

$$p_1 - p_2 = \frac{\rho}{2}(v_2^2 - v_1^2)$$

where ρ is the density of the fluid (approximately 1.225 kg/m3 for air), $v_1$ is the slower fluid velocity when a constriction is wider, $v_2$ is the faster fluid velocity when a constriction is narrower and the pressure difference is represented by $p_1-p_2$ which would allow the appropriate one-way check valve to open and air to flow from under the membrane or roof system or structure. FIG. 22B shows that the maximum airspeed to the left and right of the invention is on the order of 130 ft/sec or about 88 mph. The faster the airflow, the lower the air pressure and the result is pulling air from under the membrane due to ambient airspeed alone.

Figure 22C:
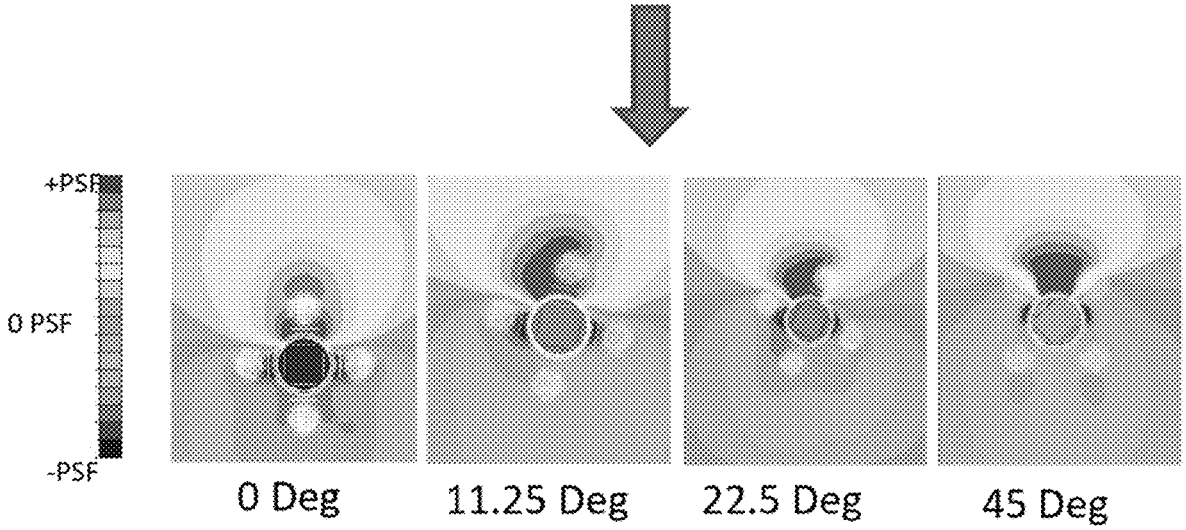
FIG. 22C is a graphical representation of fluid pressure associated with the invention.
Figure 22D:
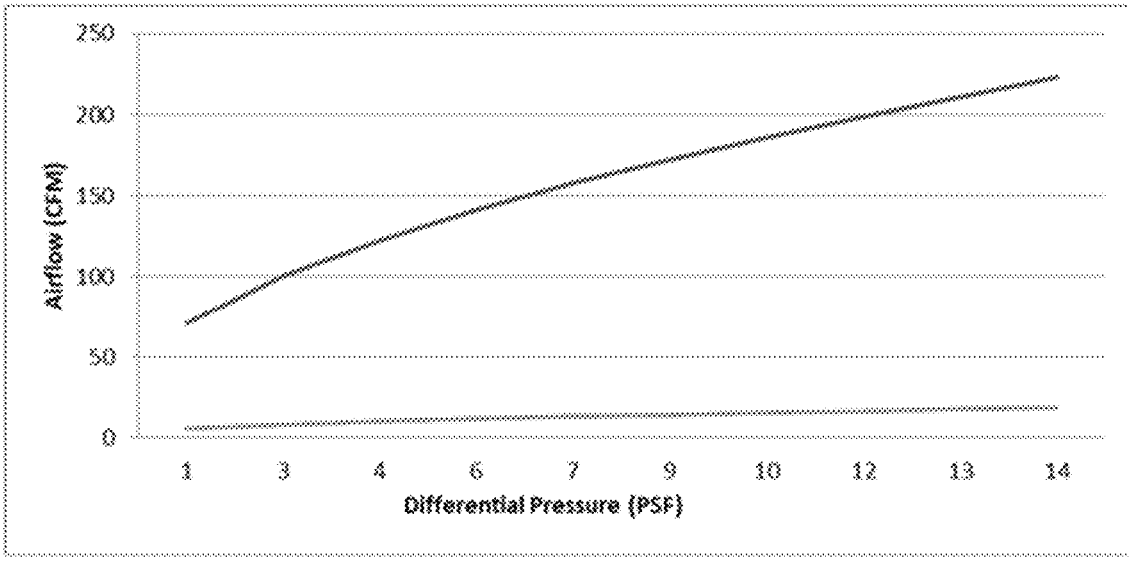
FIG. 22D is graphical representation of the physical properties provided by the present invention.

Referring to FIG. 22C, the four examples, 0, 11.25, 22.5 and 45 degrees, are a computational fluid dynamics analysis on one embodiment, showing static pressure. Each example contains a top down view of semi-transparent model of one embodiment of the invention placed in a virtual wind tunnel at four different orientations to the wind, with wind coming from the top. The examples indicate pressure is inside the invention that will be presented to underneath of the roofing system. The scale on the left side shows how to interpret the examples. As shown, the pressure inside the invention for each of the four orientations is negative with the ports shown that are contributing to the negative pressure.

Figure 23A:
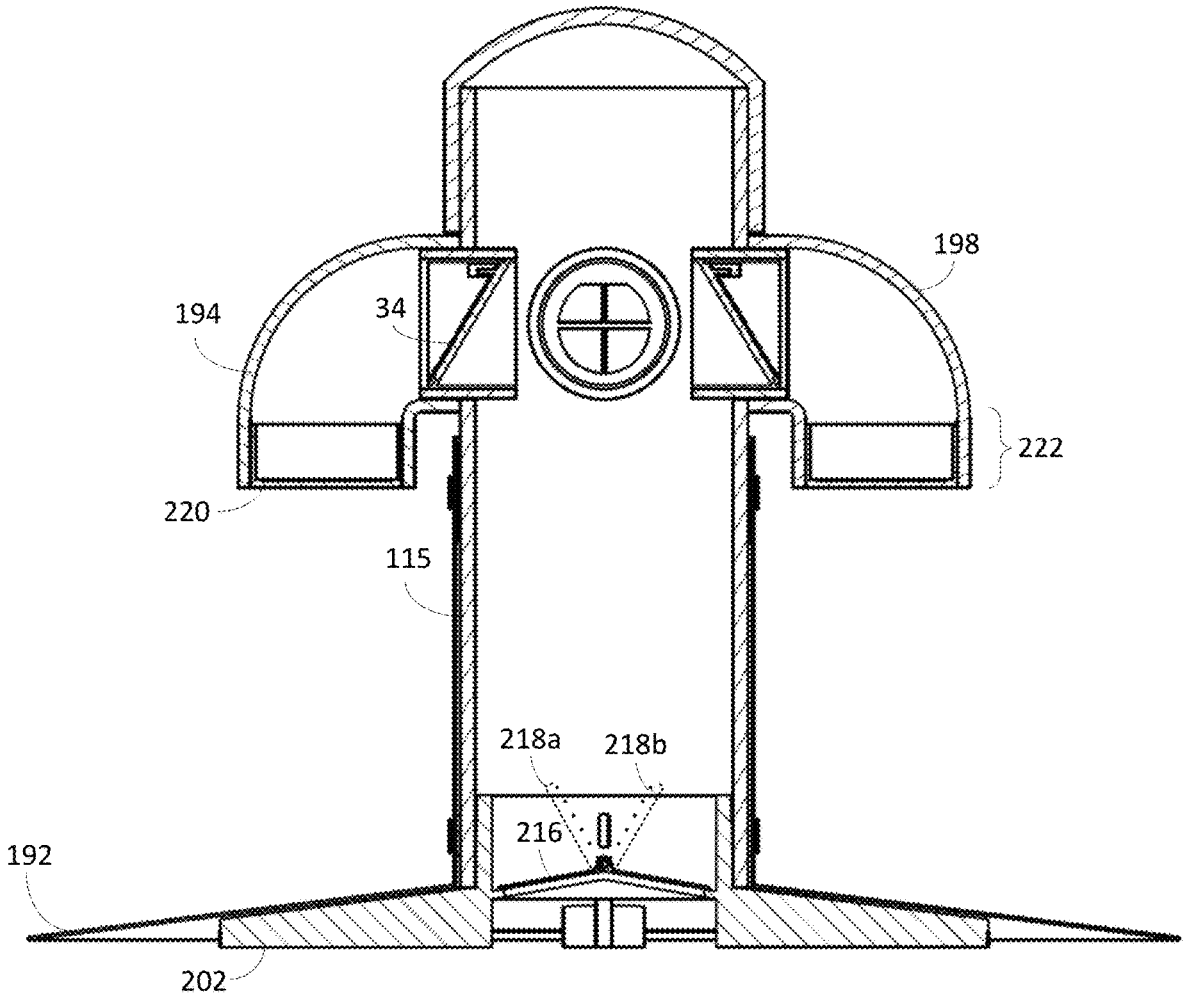
FIG. 23A is a cross section of aspects of the invention.
Figure 23B:
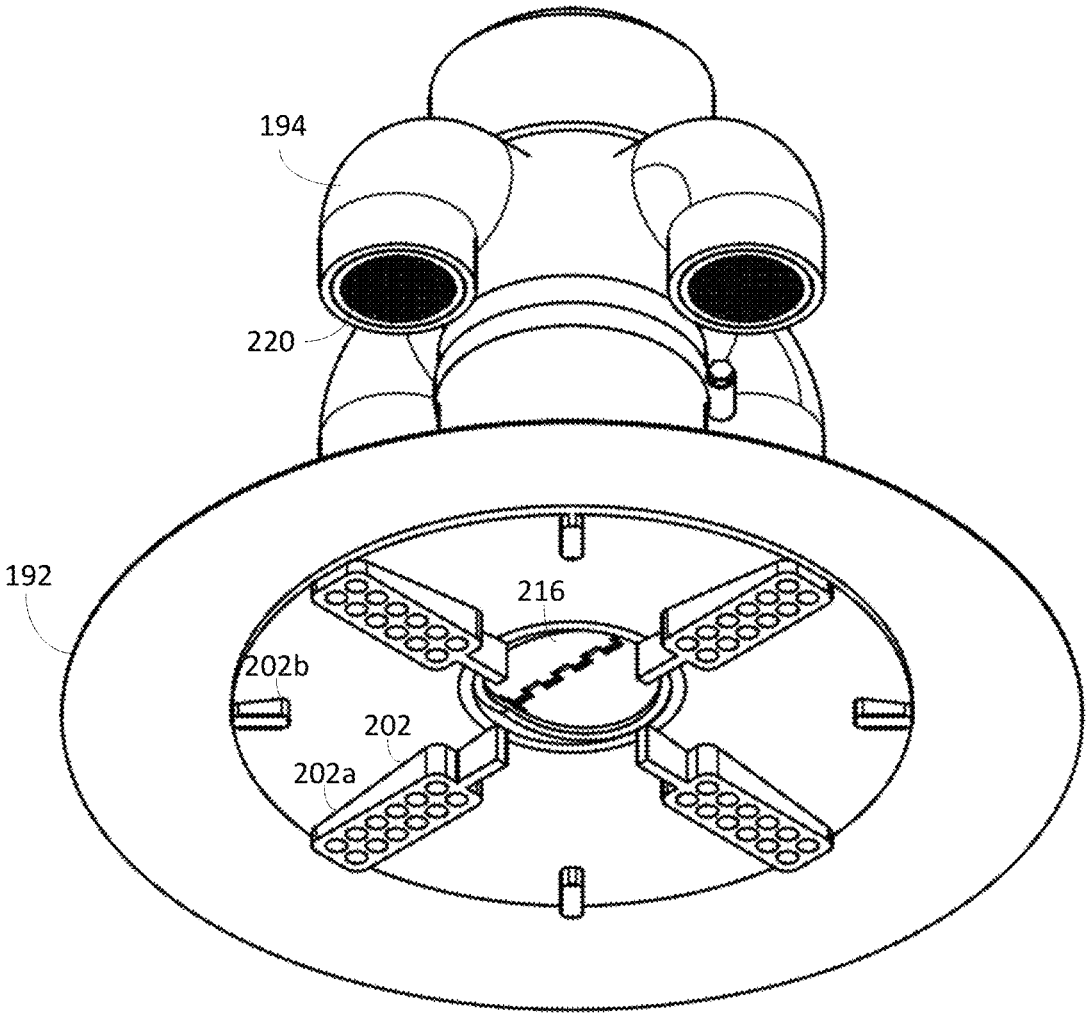
FIG. 23B is a perspective view of aspects of the invention.

Referring to FIGS. 23A and 23B, the flexible boot flange 192 can be disposed above the base assembly 202. It is intended that the roof membrane fit between the flange of the base assembly 224 and the flange of the flexible boot 192. The base assembly has a vertical horizontal stem 223 that is fitted to the inside wall of the bottom of the center tube. The flange of the base assembly 224 is a continuous plate of material that extends from the outer edge of the stem to the outer edge of the base assembly. In one embodiment, the flange of the base assembly is such that the height of the flange at the outer edge of the stem is higher than the height of the flange at the outer edge in order to assure that the airflow area between the roof deck and the base flange at any radius from the outside diameter of the stem out to the outside dimension of the base assembly is greater than or equal to sum of the cross sectional area of the inside diameter of the stem. There can be a major spacer 202*a* and minor spacer 202*b*. The spacers of the base assembly provide stability for the vent to sit upon. A lower valve, such as a backflow inhibitor valve 216, can be disposed in the lower portion of the tube. When the fluid is being pulled from the roof system, through the center tube, out any of the external extension assemblies 194, the flaps 218*a* and 218*b* of the lower backflow inhibitor valve are opening and can be disposed in the upright position as shown allowing fluid communication between the roof system and the port of the external extension assembly. In the event that fluid backflows, possibly due to a broken vent, the lower backflow inhibitor value can close, inhibiting fluid from entering into the roof system. A check valve 34 that allows one-way airflow from the center tube out to the port can be disposed in the external extension assembly. A screen 220 can be placed at or near the distal opening/port of the external extension assembly to prevent debris, bugs the like from entering the external extension assembly. The external extension assembly can include a lower extension portion 222 extending elbow 198. This can be the lower extension portion. The lower portion can be considered the vertical engagement tube to create higher velocity airflow, resulting in lower pressure at the port opening.

In one embodiment, the sum of the area of the distal openings can define an output area that can generally be equal to a flange area defined as the area defined by the air channel between the flange and the roof deck less the area of the outward faces of the spacers. The output area can be represented as output area=$\Sigma_1^n \pi r_d^2$ where n is the number of distal openings, $r_d$ is the radius of the distal openings. The output area can also be expressed as output area=$\Sigma_1^n \pi r_{nd}^2$ where $r_{dn}$ is the radius of the $n^{th}$ distal opening. In one embodiment, r can be in the range of 1.0 to 2.0 inches. The flange area can be represented as flange area=$2\pi r_f h - A_s$ where $r_f$ is the radius of the flange, h is the height of the spacers, and A*s* is the total area of the outward faces of the spacers. In one embodiment, $r_f$ can be in the range of 5.5 inches to 9 inches. If there are major and minor spacers, $A_s$ can be represented as $A_s = \Sigma_1^m a_m + \Sigma_1^n b_n$ where m is the number of major spacers, $a_m$ is the area of the outward face of a major spacer, n is the number of minor spacer and $b_n$ is the area of the outward face of a minor spacer. In one embodiment, the spacers can be rectangles with rounded ends so that the area of the spacers can be calculated by $A = ab + 2r(a+b) + \pi r^2$ where a convex hull of four equal circles with radius r is placed at the four corners of the rectangle with the side lengths of a and b.

Unless specifically stated, terms, and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A vent for a single-ply membrane roof system, the vent comprising:

a flange having spacers attached to a bottom surface of the flange defining an air channel between a decking of the single-ply membrane roof system and the flange, the air channel in fluid communication with fluid between a single-ply membrane of the single-ply membrane roof system and the decking;

a flange opening in the flange in fluid communication with the air channel;

a tube connected to the flange and in fluid communications with the flange opening defined in the flange; and a plurality of external extension assemblies extending outward from the tube, each of the external extension assemblies comprising:

an elbow extending from and in fluid communication with the tube, the elbow including a distal opening at a distal end opposite the tube and in communication with external fluid, the distal end being spaced apart from the tube; and a check valve positioned within the elbow between the distal opening and the tube to prevent air flow through the external extension assembly when in a closed position, wherein the check value is:

in the closed position when an air pressure within the tribe is lower than or equal to an air pressure at the distal opening; and in an open position when the air pressure at the distal opening is lower than the air pressure within the tube.

2. The vent of claim 1, wherein the plurality of external extension assemblies comprises at least three external extension assemblies.

3. The vent of claim 2, wherein the plurality of external extension assemblies are circumferentially disposed around a perimeter of the tube.

4. The vent of claim 3, wherein the plurality of external extension assemblies are equidistant relative to each other.

5. The vent of claim 1, further comprising:

an output area, wherein the output area is defined by a sum of surface areas of each distal opening of the plurality of external extension assemblies; and a cross-sectional area of the tube, wherein the output area is approximately equal to or greater than the cross-sectional area of the tube.

6. The vent of claim 5, further comprising a base assembly comprising:

a stem oriented above the flange, the stem in communication with the tube, wherein the stem has a cross-sectional area; and wherein the base assembly has a flange area, wherein the flange area is defined by the air channel between the flange and the decking of the single-ply membrane roof system, wherein the stem cross-sectional area is approximately equal to or greater than the flange area.

7. The vent of claim 1, wherein the distal ends extend downward from the respective elbows into an external horizontal airstream.

8. The vent of claim 1, wherein the distal openings of the plurality of external extension assemblies and the flange opening are in parallel planes.

9. A vent for a single-ply membrane roof system comprising:

a central vertical tube in fluid communication with fluid between a single-ply membrane of the single-ply membrane roof system and decking on which the single-ply membrane sits; and a plurality of external extension assemblies, wherein each external extension assembly includes:

an elbow extending outward from the central vertical tube, the elbow in fluid communication with the tube;

a distal opening at a distal end of the elbow opposite the central vertical tube, the distal end being spaced apart from the central vertical tube; and a one-way valve located within the elbow between the distal opening and the central vertical tube to prevent fluid flow through the external extension assembly when in a closed position, wherein the one-way valve is:

in the closed position when an air pressure within the central vertical tube is lower than or equal to an air pressure at the distal opening; and in an open position when the air pressure at the distal opening is lower than the air pressure within the central vertical tube.

10. The vent of claim 9, further comprising a flange, the flange attached to the central vertical tube and the decking, the flange having a flange opening allowing fluid communications between the single-ply membrane roof system and the central vertical tube.

11. The vent of claim 10, further comprising spacers attached to the flange and the decking to define an airway between the single-ply membrane, the decking, the flange, and the central vertical tube.

12. The vent of claim 9, further comprising a cap disposed at a top portion of the central vertical tube.

13. The vent of claim 11, wherein a sum of surface areas of each distal opening of the plurality of external extension assemblies creates an output area, wherein the airway has a cross-sectional area, wherein the output area is approximately equal to or greater than the cross-sectional area.

14. A vent to evacuate air from a single-ply membrane roof system, the vent comprising:

a flange comprising:

a bottom surface;

a flange opening; and spacers, wherein the flange is configured to be mounted to a decking supporting a single-ply membrane of the single-ply membrane roof system, wherein the bottom surface, the spacers, and the decking form an air channel feeding into the flange opening;

a central vertical tube connected to the flange and in fluid communication with the air channel and flange opening; and a plurality of external extension assemblies in fluid communication with the central vertical tube, each external extension assembly comprising:

an elbow connected to and in fluid communication with the central vertical tube;

a distal opening on a distal end of the elbow opposite the central vertical tube, the distal end being spaced apart from the central vertical tube, wherein the distal opening is in fluid communication to external fluid; and a check valve located within the elbow between the distal opening and the central vertical tube, the check valve configured to only allow fluid to move through the external extension assembly when in an open position, wherein the check valve remains closed when an internal air pressure in the central vertical tube is lower than an external air pressure at the distal opening;

wherein the check valve opens when the external air pressure at the distal opening of the elbow is lower than the internal air pressure in the central vertical tube, and wherein when at least one of the check valves is open, the vent counters uplift forces of turbulent wind over the single-ply membrane roof system by pulling internal fluid from between the single-ply membrane and the decking through the central vertical tube and out through the distal opening of the elbow with the at least one of the open check valves that is open.

15. The vent of claim 14 including a cap disposed on a top portion of the central vertical tube.

16. The improved vent of claim 15, wherein the plurality of external extension assemblies are disposed equidistance around a perimeter of the central vertical tube.

17. The vent of claim 14, wherein the plurality of external extension assemblies comprises at least three external extension assemblies.

* * * * *